US012630948B2

(12) United States Patent
Baranek et al.

(10) Patent No.: US 12,630,948 B2
(45) **Date of Patent: *May 19, 2026**

(54) FOAMABLE YARNS, TEXTILES AND ARTICLES INCORPORATING FOAMABLE YARNS, AND THE PROCESS OF MANUFACTURING THE SAME

(71) Applicant: NIKE, Inc., Beaverton, OR (US)

(72) Inventors: Austin Baranek, Beaverton, OR (US); Katharine Fraser, Portland, OR (US); Stephen J. Hipp, Hillsboro, OR (US); James Molyneux, Portland, OR (US); Kristen E Orme, Portland, OR (US); Margaret P. St. Clair, Beaverton, OR (US); Yang Zhao, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/461,022

(22) Filed: Sep. 5, 2023

(65) Prior Publication Data

US 2024/0052534 A1 Feb. 15, 2024

Related U.S. Application Data

(63) Continuation of application No. 17/096,664, filed on Nov. 12, 2020.

(Continued)

(51) Int. Cl.
*D02G 3/36* (2006.01)
*A43B 23/02* (2006.01)

(Continued)

(52) U.S. Cl.
CPC ..... *D02G 3/36* (2013.01); *A43B 23/0215* (2013.01); *A43B 23/025* (2013.01); *D01D 5/247* (2013.01);

(Continued)

(58) Field of Classification Search
None
See application file for complete search history.

(56) References Cited

U.S. PATENT DOCUMENTS 1,989,617 A 1/1935 Horrocks
2,440,393 A 4/1948 Clark (Continued)

FOREIGN PATENT DOCUMENTS

CA 624083 A 7/1961
CA 2489217 A1 12/2003

(Continued)

OTHER PUBLICATIONS

Khonakdar et al. ("Thermal and mechanical properties of uncrosslinked and chemically crosslinked polyethylene/ethylene vinyl acetate copolymer blends", Journal of Applied Polymer Science, vol. 103, Iss. 5, Dec. 19, 2006, pp. 3261-3270). (Year: 2006).*

(Continued)

*Primary Examiner* — Shawn Mckinnon
(74) *Attorney, Agent, or Firm* — Shook, Hardy & Bacon L.L.P.

(57) ABSTRACT

An article, such as an article of footwear includes, a textile component. The textile component includes a yarn. The yarn includes a thermoplastic material and a blowing agent with an activation condition. Upon triggering the activation condition of the blowing agent, the blowing agent introduces a plurality of cavities, i.e. cells, into the thermoplastic material, creating a multicellular foam area of the textile.

21 Claims, 8 Drawing Sheets

Related U.S. Application Data

(60) Provisional application No. 62/939,110, filed on Nov. 22, 2019, provisional application No. 62/937,117, filed on Nov. 18, 2019, provisional application No. 62/937,092, filed on Nov. 18, 2019.

(51) Int. Cl.

| | |
|---|---|
| ***D01D 5/247*** | (2006.01) |
| ***D01F 8/06*** | (2006.01) |
| ***D01F 8/14*** | (2006.01) |
| ***D02G 3/04*** | (2006.01) |
| ***D02G 3/38*** | (2006.01) |
| ***D03D 15/00*** | (2021.01) |

(52) U.S. Cl.

CPC ..... *D01F 8/06* (2013.01); *D01F 8/14* (2013.01); *D02G 3/045* (2013.01); *D02G 3/38* (2013.01); *D03D 15/00* (2013.01); *D10B 2321/021* (2013.01); *D10B 2321/08* (2013.01); *D10B 2331/04* (2013.01); *D10B 2401/041* (2013.01); *D10B 2401/08* (2013.01); *D10B 2501/043* (2013.01)

(56) References Cited

U.S. PATENT DOCUMENTS 3,100,926 A 8/1963 Richmond
3,210,446 A 10/1965 Yamakawa et al.
3,249,129 A 5/1966 Renfroe
3,389,446 A 6/1968 Parrish
3,694,873 A 10/1972 Crowley
3,847,719 A 11/1974 Crowley
3,940,355 A * 2/1976 Engelbrecht ..... C08K 3/22 524/427
4,144,371 A 3/1979 Okie et al.
4,197,345 A 4/1980 Worrall
4,265,972 A 5/1981 Rudner
4,552,920 A * 11/1985 Goto ..... C09J 123/08 525/438
4,561,128 A 12/1985 Zimmerman
4,741,941 A 5/1988 Englebert et al.
4,777,080 A 10/1988 Harris, Jr. et al.
4,803,109 A 2/1989 Saniscalchi
5,445,693 A 8/1995 Vane
5,568,779 A 10/1996 Wong
5,950,554 A 9/1999 Wong
6,007,911 A 12/1999 Bowen, Jr.
6,054,078 A 4/2000 Lauer et al.
6,225,243 B1 5/2001 Austin
6,261,679 B1 7/2001 Chen et al.
6,287,686 B1 * 9/2001 Huang ..... A41D 31/08 428/377
6,430,844 B1 8/2002 Otis et al.
6,541,403 B2 4/2003 Billarant et al.
6,548,166 B2 4/2003 Figuly et al.
6,896,843 B2 5/2005 Topolkaraev et al.
6,911,502 B2 6/2005 Vedula
7,081,221 B2 7/2006 Paratore et al.
7,357,889 B2 4/2008 Vedula et al.
7,462,573 B2 12/2008 Tsujiyama et al.
7,718,259 B2 5/2010 Pollet et al.
7,785,509 B2 * 8/2010 Perera ..... D21F 7/08 264/136
8,034,873 B2 10/2011 Siddhamalli
8,148,475 B2 4/2012 Vedula et al.
8,641,944 B2 2/2014 Wang et al.
8,800,172 B2 8/2014 Dua et al.
8,865,052 B2 10/2014 Makal et al.
9,060,562 B2 6/2015 Meir et al.
9,320,312 B2 4/2016 Lyttle et al.
9,545,773 B2 1/2017 Hansen
9,688,805 B2 6/2017 Vedula et al.
9,723,890 B2 8/2017 Long et al.
9,856,599 B2 1/2018 Park
9,915,026 B2 3/2018 Park
9,963,806 B2 5/2018 Vedula et al.
10,138,575 B2 11/2018 Van Der Gaag et al.
10,455,885 B2 10/2019 Tamm
10,590,569 B2 3/2020 Hansen et al.
10,590,571 B2 3/2020 Hansen et al.
11,059,249 B2 * 7/2021 Krichevsky ..... B29D 35/126
2001/0044477 A1 * 11/2001 Soane ..... B01J 13/20 521/60
2002/0070471 A1 6/2002 Lee et al.
2002/0172792 A1 11/2002 Jarvis et al.
2002/0175433 A1 11/2002 Day
2004/0118018 A1 6/2004 Dua
2005/0003139 A1 1/2005 Keller
2007/0039210 A1 * 2/2007 Clark ..... A43B 1/0036 36/4
2007/0049153 A1 3/2007 Dunbar et al.
2007/0082165 A1 4/2007 Barrett
2007/0141335 A1 6/2007 Perera et al.
2007/0298671 A1 12/2007 Noda et al.
2008/0028581 A1 2/2008 Ronzani
2008/0081854 A1 4/2008 Wang et al.
2008/0114093 A1 5/2008 Lagneaux et al.
2008/0254253 A1 10/2008 Gallager
2009/0151397 A1 6/2009 Sturman et al.
2009/0313856 A1 12/2009 Arizumi
2010/0062231 A1 3/2010 Abed et al.
2010/0144226 A1 * 6/2010 Guenthner ..... A62C 2/065 442/139
2010/0199406 A1 8/2010 Dua et al.
2010/0203328 A1 8/2010 Hochstetter et al.
2010/0287679 A1 11/2010 Fujita et al.
2011/0232002 A1 9/2011 Wiessner
2011/0253366 A1 10/2011 Berrigan et al.
2012/0157904 A1 6/2012 Stein
2013/0059116 A1 3/2013 Peikert et al.
2013/0139294 A1 6/2013 Zetune et al.
2013/0145652 A1 6/2013 Podhajny et al.
2013/0192086 A1 8/2013 Tawney et al.
2013/0276333 A1 10/2013 Wawrousek et al.
2013/0331478 A1 * 12/2013 La Camera ..... C08K 5/0025 524/106
2014/0196315 A1 7/2014 Beye et al.
2014/0245643 A1 9/2014 Huffa et al.
2014/0283410 A1 9/2014 Marvin et al.
2015/0013188 A1 1/2015 Seamarks et al.
2015/0059209 A1 3/2015 Dekovic et al.
2015/0201707 A1 7/2015 Bruce
2016/0083540 A1 3/2016 Makal et al.
2016/0271904 A1 9/2016 Maia et al.
2016/0286898 A1 10/2016 Manz et al.
2016/0295971 A1 10/2016 Arnese et al.
2017/0029982 A1 2/2017 Bryson, Jr. et al.
2017/0042264 A1 2/2017 Dua et al.
2017/0129200 A1 5/2017 Adami et al.
2017/0245581 A1 8/2017 Mcfarland, II et al.
2017/0348935 A1 12/2017 Leimer et al.
2017/0362570 A1 12/2017 Revel et al.
2017/0370027 A1 12/2017 Da et al.
2018/0125165 A1 5/2018 Adami et al.
2018/0255875 A1 9/2018 Mcginnity et al.
2018/0290348 A1 10/2018 Su
2018/0319925 A1 11/2018 Lu et al.
2018/0361697 A1 * 12/2018 Krichevsky ..... B29D 35/126
2019/0037967 A1 2/2019 Mcfarland, II et al.
2019/0069636 A1 3/2019 Lang et al.
2019/0082774 A1 3/2019 Tamm et al.
2019/0116927 A1 4/2019 Constantinou et al.
2019/0203389 A1 7/2019 Liu
2019/0313738 A1 10/2019 Dorjgurkhem et al.

FOREIGN PATENT DOCUMENTS

CA 2483333 A1 4/2005
CA 2905879 C 9/2014
CN 2572782 Y 9/2003
CN 102162164 A 8/2011

(56) References Cited

FOREIGN PATENT DOCUMENTS

| | | | |
|---|---|---|---|
| CN | 106930000 | A | 7/2017 |
| CN | 109532159 | A | 3/2019 |
| EP | 0629721 | A2 | 12/1994 |
| EP | 1571938 | B3 | 9/2005 |
| EP | 1573107 | B1 | 9/2005 |
| EP | 1591572 | A1 | 11/2005 |
| EP | 1884582 | A1 | 2/2008 |
| EP | 2488685 | B1 | 8/2012 |
| EP | 2530195 | A1 | 12/2012 |
| EP | 2978332 | B1 | 2/2016 |
| EP | 2530195 | * | 7/2016 |
| EP | 3078290 | A1 | 10/2016 |
| EP | 3107411 | B1 | 12/2016 |
| EP | 3128865 | B1 | 2/2017 |
| EP | 3073849 | B1 | 1/2019 |
| EP | 3594287 | A1 | 1/2020 |
| FR | 1176314 | A | 4/1959 |
| GB | 2346624 | A | 8/2000 |
| JP | 02-142568 | A | 5/1990 |
| JP | 10130991 | A | 5/1998 |
| JP | 2006-249596 | A | 9/2006 |
| JP | 2008-101285 | A | 5/2008 |
| JP | 2009-534499 | A2 | 9/2009 |
| KR | 20180060539 | A | 6/2018 |
| TW | 1617432 | B | 3/2018 |
| WO | 0051458 | A1 | 9/2000 |
| WO | 02/59414 | A2 | 8/2002 |
| WO | 2002064656 | A2 | 8/2002 |
| WO | 02068534 | A1 | 9/2002 |
| WO | 2005052235 | A1 | 6/2005 |
| WO | 2010141319 | A1 | 12/2010 |
| WO | 2011124228 | A1 | 10/2011 |
| WO | 2011127259 | | 10/2011 |
| WO | 2012073095 | A1 | 6/2012 |
| WO | 2014085206 | A1 | 6/2014 |
| WO | 2015/100369 | A1 | 7/2015 |
| WO | 2015183348 | A1 | 12/2015 |
| WO | 2015190920 | A1 | 12/2015 |
| WO | 2016014230 | A1 | 1/2016 |
| WO | 2017115806 | A1 | 7/2017 |
| WO | 2017151496 | A1 | 9/2017 |
| WO | 2018124385 | A1 | 7/2018 |

OTHER PUBLICATIONS

Office Action received for European Application No. 22200912.8, mailed on Feb. 7, 2024, 11 pages.
International Search Report and Written Opinion for PCT/US2020/044626 mailed Oct. 30, 2020.
International Preliminary Report on Patentability for PCT/US2020/044629, mailed Feb. 17, 2022.
International Search Report and Written Opinion for PCT/US2020/044629 mailed Nov. 5, 2020.
International Preliminary Report on Patentability for PCT/US2020/060247, mailed Apr. 14, 2022.
Written Opinion for PCT/US2020/060236, mailed Nov. 23, 2021.
International Preliminary Report on Patentability for PCT/US2020/044624, mailed Feb. 17, 2022.
International Search Report and Written Opinion for PCT/US2020/060236, mailed Mar. 5, 2021.
Estane® 2355-75A Technical Data Sheet, https://plastics.ulprospector.com/datasheel/e7702/estane-2355-75a-tpu, 3 pp, accessed Jun. 29, 2020.
International Preliminary Report on Patentability for PCT/US2020/044626, mailed Feb. 17, 2022.
International Preliminary Report on Patentability for PCT/US2020/060247, mailed Feb. 9, 2022.
International Search Report and Written Opinion for PCT/US2020/044628 mailed Oct. 30, 2020.
Estane® T470A Technical Data Sheet, http://www.matweb.com/search/datasheet_print.aspx?rnatguid=5539b9ce32af46358433a5a5e035570c, 1 pp, accessed Jun. 29, 2020.
International Search Report and Written Opinion for PCT/US2020/044624 mailed Oct. 30, 2020.
International Preliminary Report on Patentability for PCT/US2020/060236, mailed Apr. 7, 2022.
Estane® 58238 Technical Data Sheet, https://plastics.ulprospector.com/datasheel/e24205/estane-58238-tpu, 3 pp, accessed Jun. 29, 2020.
International Search Report and Written Opinion for PCT/US2020/060247, mailed Mar. 23, 2021.
International Preliminary Report on Patentability for PCT/US2020/044628, mailed Feb. 17, 2022.
Written Opinion for PCT/US2020/060247, mailed Oct. 28, 2021.
European Search Report and Search Opinion received for European Application No. 22200912.8, mailed on Feb. 2, 2023, 9 pages.
Khonakdar, HA., et al., "Thermal and mechanical properties of uncrosslinked and chemically crosslinked polyethylene/ethylene vinyl acetate copolymer blends", Journal of Applied Polymer Science, vol. 103, Iss. 5, Dec. 19, 2006. pp. 3261-3270.
Non-Final office action received for U.S. Appl. No. 17/096,664, mailed on Jan. 17, 2024, 12 pages.
Notice of Allowance received for U.S. Appl. No. 16/951,249, mailed on Aug. 22, 2024, 7 pages.
Office Action received for European Application No. 22200912.8, mailed on Sep. 10, 2024, 7 pages.
Office Action received for European Application No. 23169912.5, mailed on Sep. 18, 2024, 6 pages.
Final Office Action received for U.S. Appl. No. 17/096,664, mailed on Jul. 19, 2024, 8 pages.
Non-Final Office Action received for U.S. Appl. No. 16/951,249, mailed on May 8, 2024, 8 pages.
Final Office Action received for U.S. Appl. No. 17/096,664, mailed on Feb. 12, 2025, 22 pages.
Non-Final Office Action received for U.S. Appl. No. 17/096,664, mailed on Nov. 1, 2024, 8 pages.
Office Action received for European Application No. 22200912.8, mailed on Dec. 23, 2024, 3 pages.
Office Action received for European Application No. 23178257.4, mailed on Nov. 6, 2024, 5 pages.
Non-Final Office Action received for U.S. Appl. No. 17/096,626, mailed on Mar. 17, 2025, 19 pages.
Final Office Action received for U.S. Appl. No. 17/096,626, mailed on Oct. 1, 2025, 22 pages.
Non-Final Office Action received for U.S. Appl. No. 17/096,664, mailed on Jun. 30, 2025, 7 pages.
Office Action received for European Application No. 23169912.5, mailed on Jul. 3, 2025, 2 pages.
Office Action received for European Patent Application No. 22200912.8, mailed on May 6, 2025, 4 pages.
Non-Final Office Action received for U.S. Appl. No. 17/096,664, mailed on Jan. 16, 2026, 7 pages.

* cited by examiner

FOAMABLE YARNS, TEXTILES AND ARTICLES INCORPORATING FOAMABLE YARNS, AND THE PROCESS OF MANUFACTURING THE SAME

RELATED APPLICATIONS

This application is a continuation of U.S. Non-provisional patent application Ser. No. 17/096,664, filed on Nov. 12, 2020, entitled "FOAMABLE YARNS, TEXTILES AND ARTICLES INCORPORATING FOAMABLE YARNS, AND THE PROCESS OF MANUFACTURING THE SAME," which application claims the benefit of and priority to U.S. Provisional Application 62/939,110, filed on Nov. 22, 2019, entitled "FOAMABLE YARNS, TEXTILES AND ARTICLES INCORPORATING FOAMABLE YARNS, AND THE PROCESS OF MANUFACTURING THE SAME," U.S. Provisional Application 62/937,117, filed on Nov. 18, 2019, entitled "FOAMABLE AND FOAMED TEXTILES, THE PROCESS OF MANUFACTURING THE SAME, AND ARTICLES INCORPORATING THE SAME," and U.S. Provisional Application 62/937,092, filed on Nov. 18, 2019, entitled "FOAMABLE YARNS, TEXTILES AND ARTICLES INCORPORATING FOAMABLE YARNS, AND THE PROCESS OF MANUFACTURING THE SAME," the contents of which are each incorporated by reference in their entirety.

TECHNICAL FIELD

The present disclosure relates generally to a foamable yarn structure, the method of making such a foamable yarn, the method of processing such a foamable yarn, a processed foamable yarn, a textile made with a foamable yarn, a method of processing a textile with a foamable yarn, the textile that results from processing a foamable yarn, a textile including a processed foamed yarn, an article incorporating a textile including a foamable yarn, and an article that incorporates a processed textile including a foamed yarn.

BACKGROUND

Yarns have long been used in the manufacture of various textiles, and articles incorporating such textiles, including articles of apparel, footwear, and more. The incorporation of yarn into a textile can add desirable texture or other characteristics such as elasticity, strength, weight, durability, texture, breathability, cushioning, and other properties. Manufacture of the textile can include any of a number of techniques, including knitting, crocheting, weaving, inlaying, among others. These various techniques can impart different properties to the textile, such as texture, density, pattern, weave, drape, rigidity, strength, elasticity, among others. Additionally, various processes of incorporating yarn into a textile may facilitate the textile manufacture. An article made of such a textile can be manufactured efficiently with minimal material waste.

Additionally, polymeric foamed products have a variety of advantages including a low raw material consumption, low density, excellent thermal and acoustic insulation, mechanical dampening and shock absorption, low water vapor permeability, reduced moisture absorption, and more. These properties make foams useful in a variety of sectors, including packaging, thermal/acoustic insulation, upholstery, footwear and apparel.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
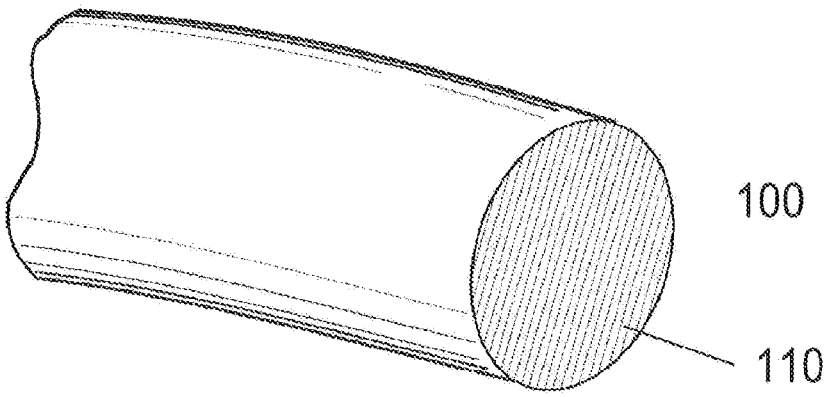
FIG. 1: a cross-sectional rendering of a monofilament strand comprising a thermoplastic material.

The subject-matter of the disclosure may also relate, among others, to the following aspects:

I. Yarn

Described herein is a yarn 100 wherein the yarn is a flexible strand comprising a least one thermoplastic material 110 comprising at least one thermoplastic polymer and a blowing agent. The first thermoplastic material 110 has a deformation temperature (at which point the materials softens) and a melting point (the temperature at which the first thermoplastic material transitions between a solid and liquid state).

Generally, a yarn is the raw material utilized to form textiles. In general, yarn is defined as an assembly having a substantial length and relatively small cross-section that is formed of at least one filament or a plurality of fibers. Fibers have a relatively short length and typically utilize spinning or twisting processes to produce a yarn of suitable length and tenacity for use in textiles. Common examples of fibers are cotton and wool. Filaments, however, have a substantially longer length and may be used alone or can be combined with other filaments to produce a yarn suitable for use in textiles. Filaments include naturally occurring materials such as silk, or can be made from a plurality of synthetic materials such as glass, carbon, or polymeric materials including rayon, nylon, polyester, and polyacrylic. Yarn may be formed of a single filament, which is conventionally referred to as a "monofilament strand" or "monofilament yarn," or a plurality of individual filaments grouped together such as by twisting or entangling. Yarn may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

A. Materials

Thermoplastic Polymer

As described herein, a thermoplastic is a substance that softens and melts on heating and hardens when cooling without undergoing a chemical transformation. The first thermoplastic materials described herein may comprise a naturally occurring thermoplastic polymeric material, a regenerated thermoplastic material, a synthetic thermoplastic material, or some combination thereof.

The first thermoplastic material may include any of a variety of synthetic thermoplastic polymers, including homopolymers or copolymers or a combination of homopolymers and copolymers. For instance, the first thermoplastic material may comprise: a thermoplastic polyurethane, including a thermoplastic polyurethane consisting essentially of polyurethane linkages, and a thermoplastic polyurethane copolymer such as a polyether-polyurethane or a polyester-polyurethane. The first thermoplastic material may comprise a thermoplastic polyolefin. The thermoplastic polyolefin may comprise a thermoplastic polyethylene homopolymer or copolymer, such as an ethylene-vinyl acetate copolymer or an ethylene-vinyl alcohol copolymer or a polyethylene-polyamide block copolymer. The thermoplastic polyolefin may comprise a thermoplastic polypropylene homopolymer or copolymer. The first thermoplastic material may comprise a thermoplastic polyester homopolymer or copolymer such as, as already mentioned, a polyester-polyurethane copolymer. The first thermoplastic material may comprise a thermoplastic polyether homopolymer or copolymer such as, as already mentioned, a polyether-polyurethane copolymer. The first thermoplastic material may comprise a thermoplastic polyamide homopolymer such as nylon 6, nylon 11 or nylon 6,6 or a polyamide copolymer such as the polyethylene-polyamide block copolymer previously mentioned. The first thermoplastic material may comprise any combination of the thermoplastic polymers disclosed above, including two or three or four of the thermoplastic polymers. The first thermoplastic material can be described as comprising a thermoplastic polymeric component made up of all the thermoplastic polymers present in the first thermoplastic material. The first thermoplastic material can comprise from about 5 weight percent to about 100 weight percent of the thermoplastic polymer component based on a total weight of the first thermoplastic material. Alternatively, the thermoplastic polymer component can comprise from about 15 weight percent to about 100 weight percent, from about 30 weight percent to about 100 weight percent, from about 50 weight percent to about 100 weight percent, or from about 70 weight percent to about 100 weight percent of the first thermoplastic material.

Additionally, in other embodiments the first thermoplastic material 110 comprises a thermosetting thermoplastic material. As described herein, a thermosetting material is a material which is initially thermoplastic but which cures and becomes a thermoset material when exposed to specific conditions (e.g., specific types and levels of heat or light or other types of actinic radiation) which initiate a chemical reaction such as a crosslinking reaction within the material. A thermosetting material is understood to be an uncured and, thus, prior to curing, is thermoplastic. When cured, a thermosetting material undergoes a chemical change and becomes a thermoset material. The examples of actinic radiation that may trigger the curing can include microwave radiation, radiowave radiation, electron beam radiation, gamma beam radiation, infrared radiation, ultraviolet light, visible light, or a combination thereof, among other conditions.

In some embodiments, the first thermoplastic material 110 further comprises a cross-linking agent. As understood in the art, cross-linking agents are chemical products that chemically form bonds between two hydrocarbon chains. The reaction can be either exothermic or endothermic, depending on the cross-linking agent used. The concentration of the cross-linking agent present in the first thermoplastic material may be sufficient to partially crosslink the first thermoplastic material, or may be sufficient to fully crosslink the first thermoplastic material. In one example, when the first thermoplastic material 110 is a thermosetting thermoplastic material, the thermosetting thermoplastic material may comprise a concentration of the cross-linking agent sufficient to fully crosslink the thermosetting thermoplastic material. One skilled in the art would be able to select any number of appropriate cross-linking agents that would be compatible with the thermoplastic polymer and allow for cross-linking of the first thermoplastic material under the desired processing conditions including temperature, pressure, UV light exposure, and the like.

In some instances a suitable cross-linking agent comprises a homobifunctional cross-linking agent. Homobifunctional reagents consist of identical reactive groups on either end of a spacer arm. Examples of homobifunctional cross-linking agents include: di(tert-butylperoxyisopropyl)benzene, dimethyl pimelimidate dihydrochloride, 3,3'-dithiodipropionic acid di(N-hydroxysuccinimide ester), suberic acid bis(3-sulfo-N-hydroxysuccinimide ester) sodium salt, among others.

In other instances, a suitable cross-linking agent comprises a heterobifunctional cross-linking agent. Heterobifunctional cross-linking agents have two distinct reactive groups, allowing for cross-linking reactions to progress in a controlled, two-step reaction. This can reduce the prevalence of dimers and oligomers while crosslinking. Examples of heterobifunctional cross-linking agents include: S-acetylthioglycolic acid N-hydroxysuccinimide ester, 5-azido-2-nitrobenzoic acid N-hydroxysuccinimide ester, 4-azidophenacyl bromide, bromoacetic acid N-hydroxysuccinimide ester, N-(3-Dimethylaminopropyl)-N'-ethylcarbodiimide hydrochloride, N-(3-Dimethylaminopropyl)-N'-ethylcarbodiimide hydrochloride, N-(3-dimethylaminopropyl)-N'-ethylcarbodiimide hydrochloride, N-(3-dimethylaminopropyl)-N'-ethylcarbodiimide hydrochloride purum, N-(3-dimethylaminopropyl)-N'-ethylcarbodiimide hydrochloride, iodoacetic acid N-hydroxysuccinimide ester, among others.

Blowing Agents

The first thermoplastic material 110 of the yarn 100 further comprises a blowing agent. As understood in the art, blowing agents are substances that decompose or vaporize at an activation temperature to produce quantities of gases or vapors. Accordingly, they can be categorized as either chemical or physical blowing agents. A chemical blowing agent is a compound which can release a gas at its activation temperature. Generally, this released gas does not chemically react with the thermoplastic polymer serving as the polymer matrix. The process of evolving gas from the blowing agent is usually exothermic; however, certain compounds that decompose through thermal dissociation, such as bicarbonates, evolve gas in a reversible and endothermic reaction. Chemical blowing agents can be further subcategorized as inorganic and organic agents. Inorganic blowing agents are used mainly in rubber technology but may be used in plastic applications to create additional cross-linking during the blowing process.

A physical blowing agent is a compound which can phase transition to a gas when the temperature, pressure, or temperature and pressure are changed. At a given pressure, the temperature at which the physical blowing agent transitions to a gas is the activation temperature. Physical blowing agents include low-boiling-point hydrocarbons or inert gasses, liquids, and supercritical fluids.

The choice of blowing agent can influence foam quality, density, homogeneity, and the costs of the foamed product. As discussed below, the characteristic property of these compounds is their activation temperature, which determines their practical use as blowing agents for a given thermoplastic material 110 and for its processing conditions. In order for the yarn 100 to be able to form a stable foam, the first thermoplastic material 110 must be deformable or molten at the activation temperature of the blowing agent. To that end, the thermoplastic-material deformation temperature may the same as or may be lower than the blowing-agent activation temperature.

In some embodiments, the thermoplastic-material deformation temperature is at least 10 degrees Celsius below the blowing-agent activation temperature. In some embodiments, the thermoplastic-material deformation temperature is at least 20 degrees Celsius below the blowing-agent activation temperature. In other embodiments, the first thermoplastic material 110 has a softening temperature or a melting temperature from about 50 degrees Celsius to about 145 degrees Celsius.

In some embodiments, the chemical blowing agent has an activation temperature that is at least 5 degrees Celsius above a melting temperature of the first thermoplastic material 110. In other embodiments, the activation temperature of the blowing agent is at least 10 degrees Celsius above the melting temperature of the first thermoplastic material 110. In further embodiments, the activation temperature of the blowing agent is at least 20 degrees above the melting temperature of the first thermoplastic material 110.

Other properties that may be considered when selecting a chemical blowing agent include the following: affinity with the thermoplastic polymer, maximum production of gases; activation temperature at which the blowing agent evolves gas, rate of gas evolution, toxicity, corrosiveness, odor of decomposition products, effect of decomposition products on the color and other physicochemical properties of the thermoplastic polymer, cost, availability, stability against decomposition during storage, and others.

In some embodiments, the blowing agent comprises a chemical blowing agent. In some embodiments, the chemical blowing agent comprises sodium bicarbonate, ammonium carbonate, ammonium bicarbonate, calcium azide, azodicarbonamide, hydrazocarbonamide, benzenesulfonyl hydrazide, dinitrosopentamethylene tetramine, toluenesulfonyl hydrazide, p,p'-oxybis(benzenesulfonylhydrazide), azobisisobutyronitrile, barium azodicarboxylate, or any combination thereof.

In some embodiments, the blowing agent comprises a physical blowing agent. In addition to partially halogenated fluorochlorohydrocarbons, hydrocarbons (e.g. isobutene and pentane) and inert liquids, gases or supercritical fluids, such as carbon dioxide or nitrogen or a combination thereof, can serve as physical blowing agents. Inert liquids, gases and supercritical fluids offer many advantages, including, low environmentally harmful outputs, low gas consumption, increased foam volume per weight of blowing agent used, high cost-effectiveness, non-flammable, non-toxic, chemically inert, minimal or no residues left behind in the polymeric foam after processing. Additionally, carbon dioxide has the advantage of having a higher solubility in many thermoplastic polymers than other inert compounds, such nitrogen.

In some embodiments, the blowing agent is present in the first thermoplastic material 110 in an amount effective to foam the first thermoplastic material 110 into a multicellular foam 310 structure when the yarn 100 is processed. The amount of blowing agent may be measured as the concentration of blowing agent by weight in the first thermoplastic material 110. An amount of blowing agent is considered effective when activating the blowing results in at least a 10 percent increase in the volume of the first thermoplastic material. In one example, the first thermoplastic material can comprise from about 1 percent to about 10 percent by weight, or from about 1 percent to about 5 percent by weight, or from about 1 percent to about 3 percent by weight of the blowing agent based on a total weight of the first thermoplastic material. In another example, the first thermoplastic material comprises a concentration of the blowing agent sufficient to expand the first thermoplastic material by at least 100 percent by volume, or by 100 percent to 900 percent by volume, or by 200 percent to 500 percent by volume, or by 300 percent to 400 percent by volume, based on an initial volume of the first thermoplastic material prior to foaming.

In some embodiments, more than one blowing agent may be used. The combination of blowing agents may comprise at least two chemical blowing agents, at least two physical blowing agents, or a combination of a physical blowing agent and a chemical blowing agent. Each blowing agent has an activation temperature at the given processing pressure. These activations temperatures may be about the same or may differ. By utilizing blowing agents with different activation temperatures, processing of the yarn 100 into a multicellular foam 310 structure can take place over a larger operation window of temperatures. Additionally, by controlling the temperature to activate a first blowing agent and then increasing the temperature of the yarn 100 to activate the second blowing agent, a variety of different desirable foam structures can be achieved. In some embodiments, two blowing agents may have activation temperatures that differ by at least about 5 degrees Celsius. In some embodiments, two blowing agents may have activation temperatures that differ by at least about 10 degrees Celsius. In some embodiments, two blowing agents may have activation temperatures that differ by at least about 20 degrees Celsius.

Other Additives

A wide range of additives may also be used. Catalysts speed up the reaction or, in some cases, reduce the reaction initiation temperature. As discussed above, blowing agents that form gas bubbles in the polymer or polymerizing mixture produce foam. Surfactants may be added to control the size of bubbles. In addition to the blowing agent and the optional cross-linking agent, other additives that may be present in the first thermoplastic material include a chain-extending agent, a filler, a flame retardant, a coloring material (such as a dye or pigment), an ultraviolet light absorber, an antioxidant, a lubricant, a plasticizer, an emulsifier, a rheology modifier, an odorant, a deodorant, a halogen scavenger, or any combination thereof, depending on the application. In one example, the other additive is present in the first thermoplastic material at a concentration of from about 0.1 weight percent to about 20 weight percent, or from about 0.2 weight percent to about 10 weight percent, or from about 0.5 weight percent to about 5 weight percent, based on a total weight of the first thermoplastic material.

The molecular structure, amount, and reaction temperature of each ingredient determine the characteristics and subsequent use of the yarn 100 after processing. Therefore, each formulation may be designed with the proper ingredients to achieve the desired properties of the final material. By way of an example, different blowing agents may require additional additives to maintain thermal properties. Ultimately, the density of the foam after the yarn 100 is processed is determined by the number and size of the cells, which is affected, at least in part, by the amount of blowing that takes place during processing. By mixing different combinations of the starting materials, the rates of the reactions and overall rate of cure during processing can be controlled.

B. Yarn Structure

Figure 2:
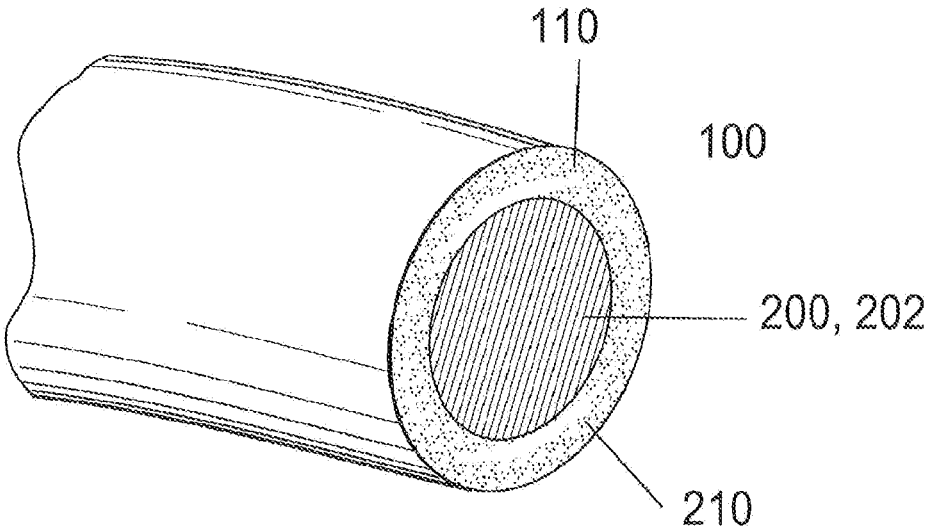
FIG. 2: a cross-sectional rendering of a yarn with an inner core and a coating comprising a thermoplastic material.

As exemplified in FIG. 1, in a first example, the yarn 100 is a monofilament consisting essentially of the first thermoplastic material 110. In a second example, exemplified in FIG. 2, the yarn 100 includes a core 200, comprising a core material 202 coated with a coating 210. In some embodiments the coating 210 comprises the first thermoplastic material 110. The core 200 may comprise any of a variety of natural polymeric fibers or filaments, regenerated fibers or filaments, synthetic polymeric fibers or filaments, metals, or some combination thereof, to achieve the desired properties of the yarn 100. The fibers or filaments may be either plant-derived or animal-derived. Plant-derived fibers may include cotton, flax, hemp, or jute. Animal-derived fibers or filaments may include spider silk, silkworm silk, sheep wool, or alpaca wool. The regenerated material is created by dissolving a cellulosic material in a solvent and spinning the solution into fibers or filaments, such as by the viscose method. Examples of regenerated fibers or filaments may include rayon or modal, among others. In some embodiments, the core material is a thermoplastic core material 202, i.e., a polymeric material having a deformation temperature at which the core material 202 softens and a melting temperature at which the core material melts. In other embodiments, the core material is a thermoset core material, i.e., a core material which does not have a deformation or melting temperature, or is a thermoformable core material, i.e., a core material having a deformation temperature but not a melting temperature. Additionally, the core 200 may be a single monofilament strand or a multifilament strand, comprising multiple monofilaments or multifilament strands. In the instance where the core is a multifilament strand, the individual filaments of the multifilament may be aligned, twisted together, knotted, braided, or the like. For instance, the yarn 100 may include a multifilament twisted or entangled polyethylene terephthalate (PET) core 200. Additionally, each strand of the multifilament core 200 may be, itself, either a monofilament or multifilament strand. In the instances where a strand of the multifilament core 200 is, itself, a multifilament comprising multiple sub-strands, the sub-strands may be aligned, twisted together, entangled, knotted, braided, or similarly interconnected. Additionally, in some embodiments, the sub-strands may be coated in the first thermoplastic material 110 such that it surrounds the sub-strand itself before the sub-strand is incorporated into the core 200.

The presence of the core 200 in the yarn 100 provides advantages such as providing tensile strength and/or stretch resistance to the yarn 100 which are not provided by the first thermoplastic material 110, and so would not be present if the first thermoplastic material 110 coating composition was used alone. The core 200 may provide a structure enabling the yarn 100 to remain in place during and following the foaming process. Additionally, when the yarn 100 is combined with non-foamable or unfoamed yarns in a textile, the presence of the core 200 can provide additional strength to the textile. In one example, when the yarn 100 is included in a textile in a manner such that the yarn 100 has little if any give or freedom of movement (e.g., when it is inlaid rather than interlooped), the presence of the core 200 can serve to add lock-out to the portion of the textile in which yarn 100 is included.

In some embodiments the core 200 has a percent elongation of less than about 30 percent, or of less than about 25 percent. For example, the core 200 may have a percent elongation from about 0.5 percent to about 30 percent or from about 5 percent to about 25 percent.

In other embodiments, the core 200 has a breaking strength from about 0.5 to about 10 kilograms force per square centimeter. The core 200 can have a breaking strength of at least 1.5 kilograms force per square centimeter, such as from about 1.5 to about 10 kilograms force per square centimeter, or from about 1.5 kilograms force per square centimeter to about 4.0 kilograms force per square centimeter, or from about 2.5 kilograms force per square centimeter to about 4 kilograms force per square centimeter.

Another measure of the force required to break a yarn is tenacity. As used herein, "tenacity" is understood to refer to the amount of force (expressed in units of weight, for example: pounds, grams, centinewtons or other units) needed to rupture a yarn (i.e., the breaking force or breaking point of the yarn), divided by the linear mass density of the yarn expressed, for example, in (unstrained) denier, decitex, or some other measure of weight per unit length. The amount of force needed to break a yarn (the "breaking force" of the yarn) is determined by subjecting a sample of the yarn to a known amount of force by stretching the sample until it breaks, for example, by inserting each end of a sample of the yarn into the grips on the measuring arms of an extensometer, subjecting the sample to a stretching force, and measuring the force required to break the sample using a strain gauge load cell. Suitable testing systems can be obtained from Instron (Norwood, Mass., USA). Yarn tenacity and yarn breaking force are distinct from burst strength or bursting strength of a textile, which is a measure of the maximum force that can be applied to the surface of a textile before the surface bursts.

Generally, in order for a yarn to withstand the forces applied in an industrial knitting machine, the minimum tenacity required is approximately 1.5 grams per denier (g/D). Most synthetic polymer continuous filament yarns formed from commodity polymeric materials generally have tenacities in the range of about 1.5 g/D to about 4 g/D. For example, polyester filament yarns that may be used in the manufacture of knit uppers for article of footwear have tenacities in the range of about 2.5 g/D to about 4 g/D. Filament yarns formed from commodity synthetic polymeric materials which are considered to have high tenacities generally have tenacities in the range of about 5 g/D to about 10 g/D. For example, commercially available package dyed polyethylene terephthalate filament yarn from National Spinning (Washington, N.C., USA) has a tenacity of about 6 g/D, and commercially available solution dyed polyethylene terephthalate filament yarn from Far Eastern New Century (Taipei, Taiwan) has a tenacity of about 7 g/D. Filament yarns formed from high performance synthetic polymer materials generally have tenacities of about 11 g/D or greater. For example, filament yarns formed of aramid typically have tenacities of about 20 g/D, and filament yarns formed of ultra-high molecular weight polyethylene (UHMWPE) having tenacities greater than 30 g/D are available from Dyneema (Stanley, N.C., USA) and Spectra (Honeywell-Spectra, Colonial Heights, Va., USA).

In one embodiment, the core 200 has a tenacity of at least 1.5 grams per denier (g/D). The core 200 can have a tenacity from about 1.5 g/D to about 4 g/D, or from about 2.5 g/D to about 4 g/D, or from about 5 g/D to about 35 g/D, or from about 5 g/D to about 10 g/D.

Linear mass density of the yarn 100 and the core 200 can be expressed in (unstrained) denier. In one embodiment, the yarn has a linear mass density from about 100 to about 300,000 denier (D), or from about 500 to about 200,000 D, or from about 1,000 to about 10,000 D. Similarly, the core may have a linear mass density from about 60 to about 70,000 D, from about 100 to about 1,000 D, or from about 150 to about 700 D.

Figure 3:
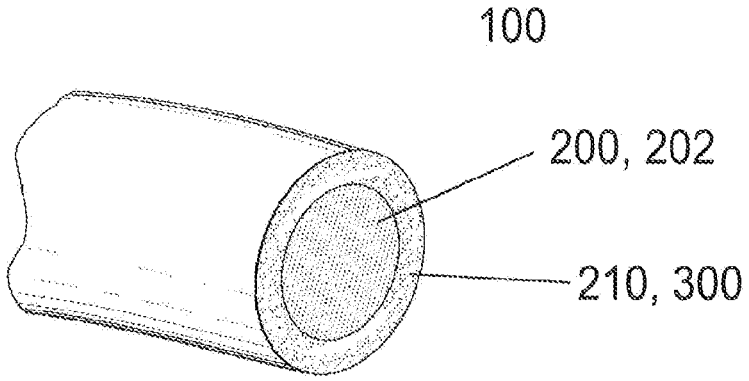
FIG. 3: a cross-sectional rendering of an inner core and an outer coating comprising a thermoplastic material before treatment to foam the thermoplastic material.
Figure 4:
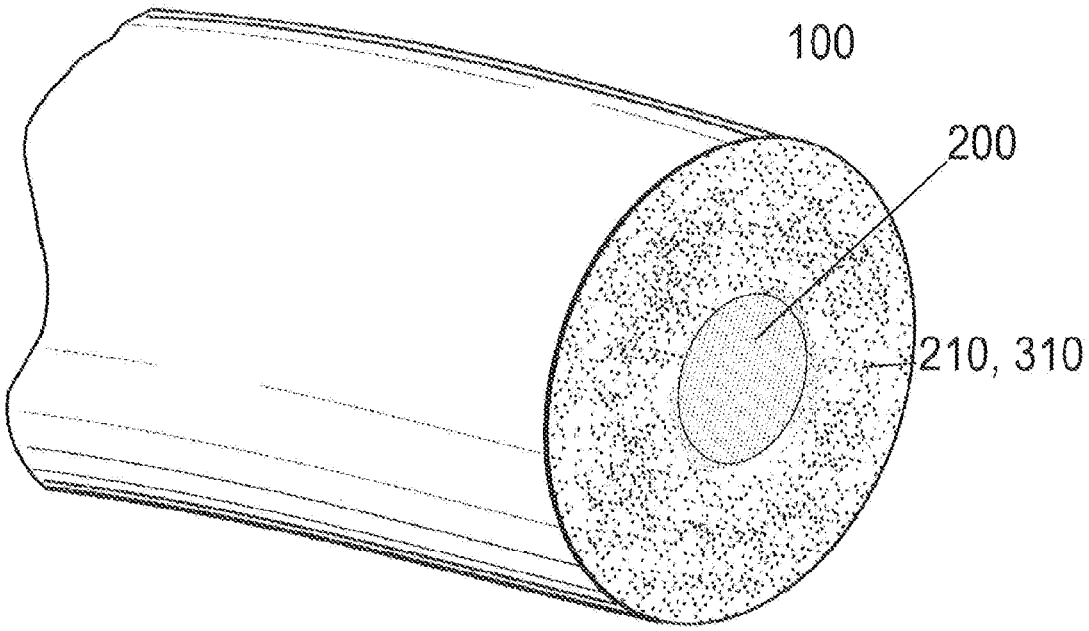
FIG. 4: a cross-sectional view of the yarn of FIG. 3 after treatment to foam the thermoplastic material.

In some embodiments, the core material 202 comprises the first thermoplastic material 110 further comprising the thermoplastic polymer and the blowing agent, as described above. Alternatively, in other embodiments, the core material 202 does not comprise a blowing agent or does not foam under the activation conditions at which the first thermoplastic material 110 foams. In embodiments where the core material 202 is unfoamed, as shown in FIGS. 3 and 4, the cross-sectional area of the core 200 remains largely unchanged from the state before activating the blowing agent of the thermoplastic material, as shown in FIG. 3, to after activating the blowing agent to create a multicellular foam 310, as shown in FIG. 4, and as detailed below.

In some embodiments, the core 200 comprises at least one filament, and the at least one filament is at least partially surrounded by the first thermoplastic material 110. In other embodiments, the at least one filament is substantially surrounded by the first thermoplastic material 110 such that the first thermoplastic material 110 covers at least 75 percent of a surface area of the at least one filament.

Figure 5:
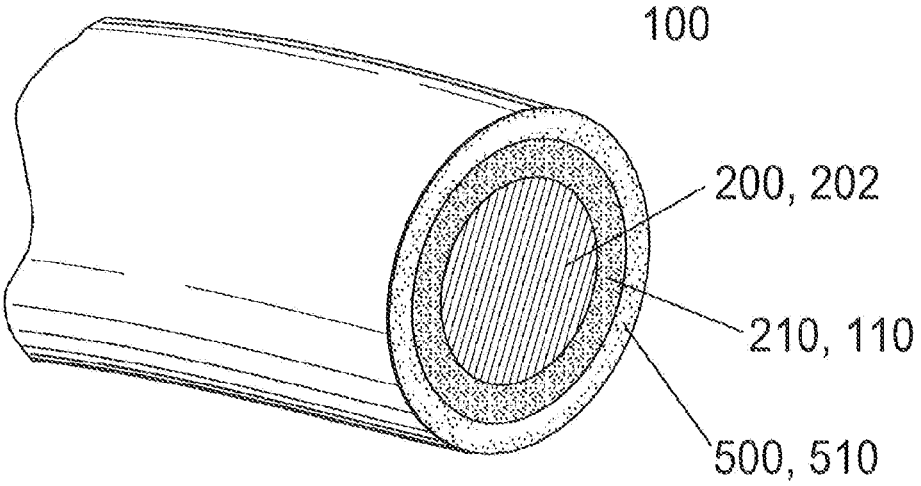
FIG. 5: a cross-sectional view of a yarn having a core surrounded by a plurality of coatings.
Figure 6:
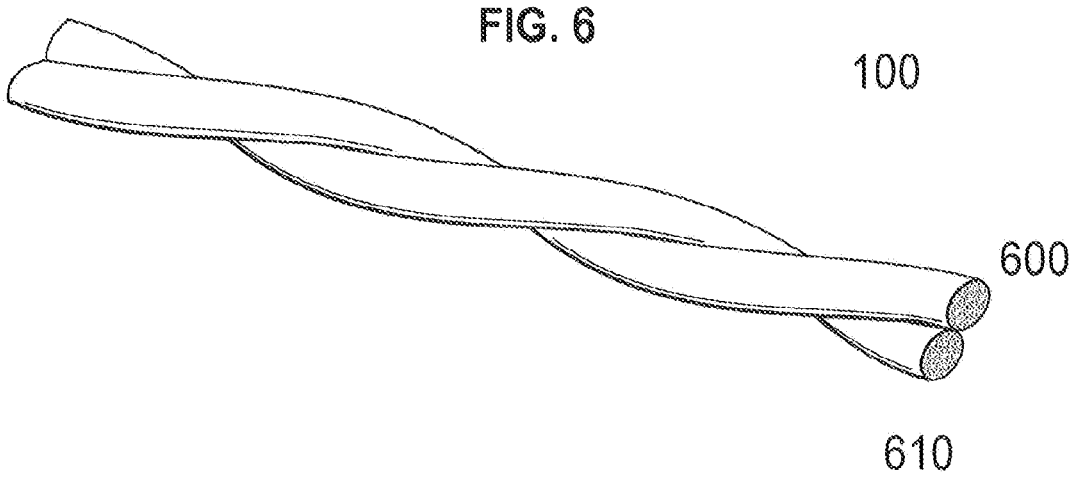
FIG. 6: a cross-sectional view off a yarn comprising two entwined sub-strands.

In a different embodiment, exemplified in FIG. 5, the yarn 100 comprises the core 200 including the core material 202, and a coating of the first thermoplastic material 110 including the blowing agent, and is coated with a coating 500 comprising a second thermoplastic material 510 comprising a second thermoplastic polymer and second blowing agent, wherein second coating 500 forms the outer layer of the yarn 100. In this embodiment, the blowing agents or thermoplastic polymers or both of the first thermoplastic material 110 and the second thermoplastic material 510 may be the same or different, or may have the same of different concentrations. Additionally, the first thermoplastic material 110 and the second thermoplastic material 510 may have the same or different additives.

In some embodiments the first thermoplastic material 110 and second thermoplastic material 500 may comprise the same blowing agent and the same thermoplastic polymers but in differing amounts. For instance, the first thermoplastic material 110 may contain a thermoplastic polyurethane with a thermally-activated chemical blowing agent but such that the concentration of the thermally activated chemical blowing agent in the first thermoplastic material 110 is at least twice the concentration of the thermally-activated chemical blowing agent in the second material. When processed, such a structure may create coaxially-aligned regions of foam with different density and hardness characteristics, or, under certain processing conditions, may yield a yarn where a coaxial foam region has a density or hardness gradient along the cross-sectional radius.

Similarly, by varying the concentration of various additives, such as, but not limited to coloring agents, cross-linking agents, stabilizers, emulsifiers, binders, or others, in different coaxial coating layers, the yarn as seen in FIG. 5, before and after being foamed, may have any number distinct coaxial regions with distinct properties, or have a radial gradient of varying properties such as color density, foam density, hardness, viscosity, melting temperature, among other properties.

Figure 7:
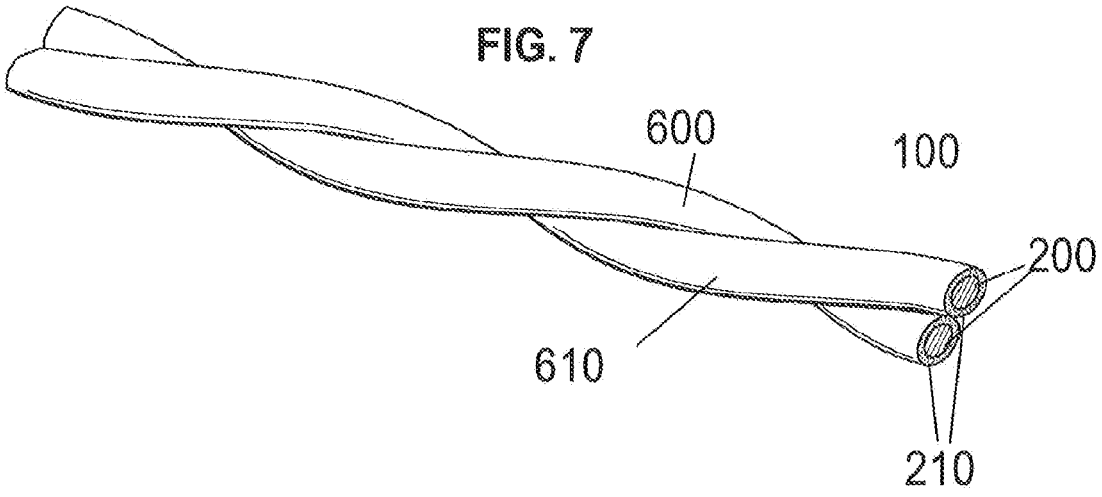
FIG. 7: a cross-sectional view of the yarn of FIG. 6, wherein each sub-strand comprises a yarn with a core and a coating.
Figure 8:
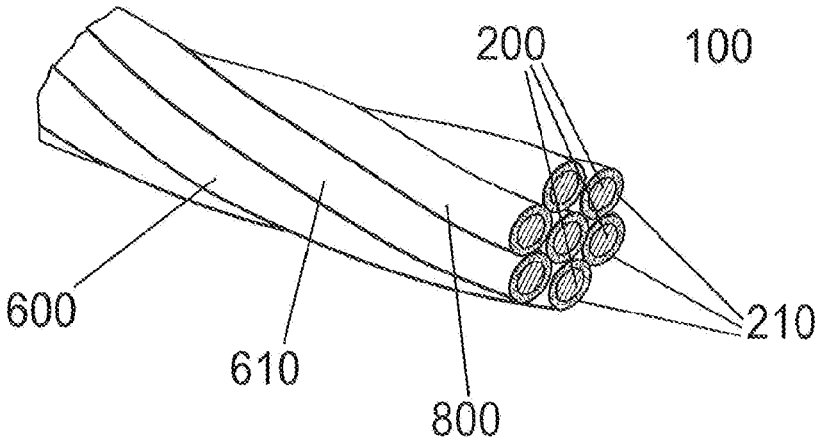
FIG. 8: a cross-sectional view of a yarn comprising multiple entwined sub-strands, wherein each sub-strand comprises a yarn with a core and a coating.
Figure 9:
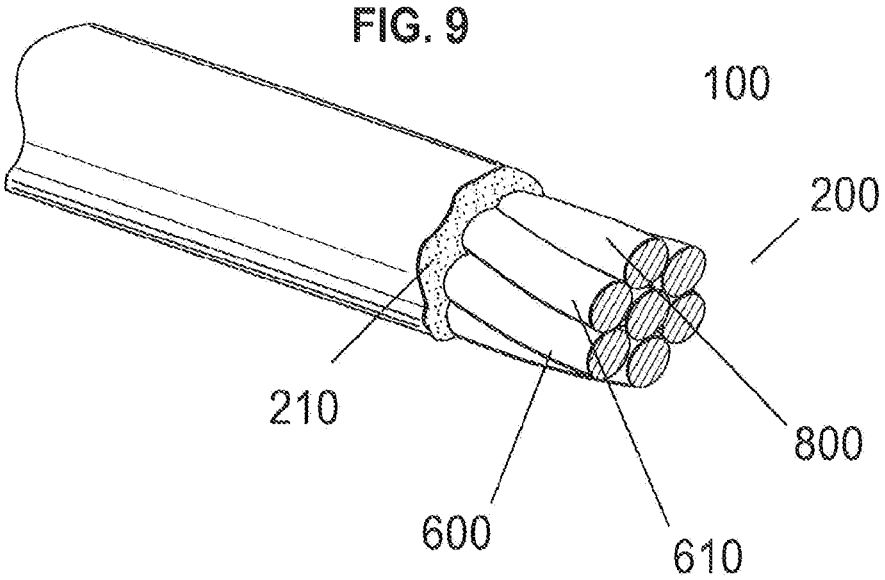
FIG. 9: a cross sectional view of a yarn comprising a core comprising multiple entwined sub-strands, wherein the core is surrounded by a coating.

In other embodiments, the yarn 100 may comprise a first yarn sub-strand 600 comprising a thermoplastic material 110 further comprising a blowing agent and thermoplastic polymer, and may be combined with a second yarn sub-strand 610. The second yarn sub-strand 610 may or may not comprise a thermoplastic material. As exemplified in FIGS. 6-9, the first yarn sub-strand 600 and second yarn sub-strand 610 may be combined to form a multi strand yarn 620, either by twisting, twining, braiding, knotting, aligning, fusing, softening the yarn materials, or other acceptable means. In further embodiments, as exemplified in FIG. 7, the yarn 100 may comprise a first yarn sub-strand 600 comprising core 200 and a coating 210 of a thermoplastic material 110 comprising a blowing agent and thermoplastic polymer.

C. Yarn Cross Sections

The yarn 100 may have any of a variety of cross-sectional shapes or sizes, dictated by the requirements for the final application of the yarn 100. In some embodiments, further detailed above, the yarn 100 comprises a core 200 and a coating 210 that is coaxial to the core 200. At any given cross-section of the yarn 100, the core has a cross-sectional area and the coating as a cross-sectional area. The average coating cross-sectional area is equal to the volume of the coating 210 divided by the length of the yarn 100. For any given cross-section of the yarn 100, the coating 210 has an average thickness being the average distance as measured from an inner surface of the coating to an exterior surface of the coating, as measured normal to the outer surface of the coating 210. In some embodiments, the diameter of the core 200 is smaller than the average thickness of the coating 210. For example, the core 200 may have a cross-sectional diameter and the surrounding coating 210 has an average thickness such that the cross-sectional diameter of the core 200 is at least 1.5 times smaller, or at least 2 times smaller, or at least 3 times smaller than the average thickness of the coating 210 prior to foaming the yarn 100. In other embodiments, the diameter of the core 200 is greater than the average thickness of the coating 210. In such an example, the core 200 can have a cross-sectional diameter and the surrounding coating 210 has an average thickness such that the cross-sectional diameter of the core 200 is at least 2 times larger, or at least 3 times larger, or at least 5 times larger than the average thickness of the coating 210.

In some embodiments the coating 210 has an average thickness from about 0.3 mm to about 5.0 millimeters. In yet other embodiments the coating 210 has an average thickness less than about 0.3 millimeters. In yet other embodiments the coating 210 has an average thickness greater than about 5.0 mm. In still other embodiments, the coating 210 has a thickness from about 0.4 millimeters to about 3.0 millimeters, or from about 0.5 millimeters to about 2 millimeters. In some embodiments the coating 210 has a variable thickness, and the variable thickness ranges from 0.1 millimeters to about 6.0 millimeters.

In some embodiments, the yarn 100 includes a core yarn comprising a core material with a layer of the first thermoplastic material 110 substantially surrounding the core layer and defining an exterior surface of the yarn 100. In one such embodiment, the first thermoplastic material 110 of the yarn 100 comprises at least 30 weight percent of a thermoplastic polymeric component, wherein the thermoplastic polymeric component includes at least one thermoplastic polyurethane, or at least one thermoplastic polyolefin, or at least one thermoplastic polyamide, or any combination thereof. The thermoplastic polymeric component of the first thermoplastic material 110 can comprise or consist essentially of at least one thermoplastic polyurethane, such as a polyester polyurethane copolymer. The thermoplastic polymeric component can comprise or consist essentially of at least one polyolefin, such as an ethylene-vinyl acetate copolymer. The thermoplastic polymeric component can comprise or consist essentially of at least one polyamide, such as a polyethylene polyamide block copolymer. In one such embodiment, the first thermoplastic material 110 further comprises a thermally-activated chemical blowing agent, and a thermally-activated crosslinking agent. In one such embodiment, the core yarn is a multifilament yarn, such as an air-entangled multifilament yarn, and has a breaking strength greater than 1.5 kilograms force per square centimeter. The core material of the core yarn can comprise at least one thermoplastic polyester such as a thermoplastic polyethylene terephthalate, or at least one thermoplastic polyamide homopolymer. In one such embodiment, a deformation temperature of the core material is at least 20 degrees Celsius, or at least 40 degrees Celsius, or at least 60 degrees Celsius greater than a melting temperature of the first thermoplastic material 110, than an activation temperature of the thermally-activated blowing agent, and than an activation temperature of the thermally-activated crosslinking agent. In one such embodiment, the yarn 100 including the unfoamed thermoplastic material 110 has a breaking strength greater than 1.5 kilograms force per square centimeter, an elongation of less than 20 percent. In one such embodiment, the thickness of the coating layer of the first thermoplastic material 110 ranges from about 0.4 millimeters to about 3 millimeters, and expands in volume from about 2 times to about 6 times when foamed.

Method for Making the Yarn

Described herein are methods of forming any of the yarns 100 described above, wherein the yarn 100 is a strand comprising at least one thermoplastic material 110 comprising at least one thermoplastic polymer and a blowing agent.

For instances where the yarn 100 is a monofilament comprising the first thermoplastic material 110, one embodiment of the method of forming the yarn 100 comprises extruding the first thermoplastic material 110. In other embodiments, the first thermoplastic material 110 is applied to a core 200.

The method may further comprise increasing a temperature of the first thermoplastic material 110 to a temperature at or above its melting temperature. The step of increasing the temperature of the first thermoplastic material 110 may comprise increasing the temperature using conductive heating, convective heating, electromagnetic radiation, or any combination thereof. For example, increasing the temperature may comprise exposing the first thermoplastic material 110 to a heating solid surface, a heating fluid, microwave radiation, radio wave radiation, electron beam radiation, gamma beam radiation, infrared radiation, ultraviolet light, visible light, or any combination thereof.

In one embodiment, the step of increasing a temperature of the first thermoplastic material 110 may include increasing the temperature to a temperature at or above a melting temperature of the first thermoplastic material 110 but at least 5 degrees Celsius below an activation temperature of the blowing agent. This allows the first thermoplastic material 110 to melt without substantially activating the blowing agent.

In a second embodiment, the method is directed to the formation of a yarn comprising a core 200, as described above. In this embodiment, the method comprises the step of coating the core 200 with the first thermoplastic material 110. In some embodiments, the coating step comprises pulling a core 200 through molten thermoplastic material, such as a liquid bath of molten thermoplastic material, or through a bore of an extruder at a temperature at or above the melting point of the first thermoplastic material 110.

Similar to above, in some embodiments of this method, the temperature of the molten thermoplastic material is at least 5 degrees Celsius below an activation temperature of the blowing agent. This allows the molten thermoplastic material 110 to coat the core 200 without substantially activating the blowing agent.

In a further embodiment, the method of coating the yarn can be repeated with a second, and optionally different, thermoplastic material 110 comprising a second thermoplastic polymer and a second blowing agent, wherein the first and second blowing agents have a first activation temperate and a second activation temperature, respectively. The first and second activation temperatures may be within about 5 degrees Celsius of each other, or, in other embodiments, there may be a difference of greater than 5 degrees Celsius between the first and second activation temperatures. The step of coating the core 200 may comprise pulling the core 200 through any number of molten thermoplastic materials, forming additional coaxial coatings around the core 200.

Any of the methods described may further comprise the additional step of decreasing the temperature of the first thermoplastic material 110 to a temperature below its deformation temperature, allowing the first thermoplastic material 110 to solidify in contact with the core 200. The step of decreasing the temperature may comprise allowing the first thermoplastic material 110 to cool at ambient conditions, exposing the thermoplastic to a fluid at a temperature below the temperature of the first thermoplastic material 110, contacting the thermoplastic with a cooling solid mass that is below the temperature of the first thermoplastic material 110, or any combination thereof. The cooling fluid may be a liquid, such as water or alcohol, or a gas, such as air or an inert gas, such as nitrogen. The cooling solid mass may be a metal, ceramic, polymer, composite, or some combination thereof. Additionally, for the methods directed to forming yarn comprising a core 200 surrounded by a coating, the additional step of cooling may be performed between any of the coating steps to aid in forming distinct layers of coaxial coatings.

II. Unprocessed Textile Comprising the Yarn

Described herein is a textile 1000 comprising any of the yarns 100 described above, wherein the yarn 100 is a strand comprising a least one thermoplastic material 110 comprising at least one thermoplastic polymer and a blowing agent. In other words, when the first thermoplastic material 110 of the yarn 100 is in an unfoamed state, the yarn 100 is a "foamable" yarn, and the textile 1000 comprising the "foamable" yarn is a "foamable" textile.

Generally, a textile may be defined as a structure manufactured from fibers, filaments, or yarns characterized by flexibility, fineness, and a high ratio of length to thickness. Textiles generally fall into two categories. The first category includes textiles produced directly from webs of fibers, filaments and/or yarns by randomly interlocking the fibers, filaments and/or yarns to construct non-woven textiles such as felts. The second category includes textiles formed through a mechanical manipulation of yarn(s) (e.g., by interlacing or interlooping one or more yarns) to produce the textile. Examples of textiles produced through mechanical manipulation include woven textiles, knitted textiles, crocheted textiles, braided textiles, and tatted textiles.

The yarn 100 can be incorporated into a variety of textile structures by mechanically manipulating the yarn 100 through a variety of means including, but not limited to, knitting, weaving, crocheting, braiding, tatting, and wrapping, among others. The yarn 100 can be incorporated into a textile structure by inlaying the yarn 100 into a textile structure. For example, the yarn can be inlaid during a weaving, knitting, crocheting, braiding or tatting process. The inlaid yarn 100 can be held in place by one or more yarns forming the structure of the mechanically manipulated textile. In knitting and crocheting, inlaying involves positioning a yarn in the structure of a textile without forming loops with the yarn. For example, in a double-needle flat knitting process, the inlaid yarn 100 can be incorporated into the knit structure by positioning the yarn between the needlebeds, without forming loops with the inlaid yarn 100. In weaving, the inlaid yarn 100 can form a portion of the weft yarns. In one embodiment, the yarn 100 can be both inlaid and knit, crocheted, braided, tatted or woven into the textile structure, where the yarn 100 is inlaid in a first portion of the textile structure, and is knit, crocheted, braided, tatted or woven in a second portion of the textile structure. In another embodiment, the yarn 100 is only inlaid into the textile structure.

Figure 10A:
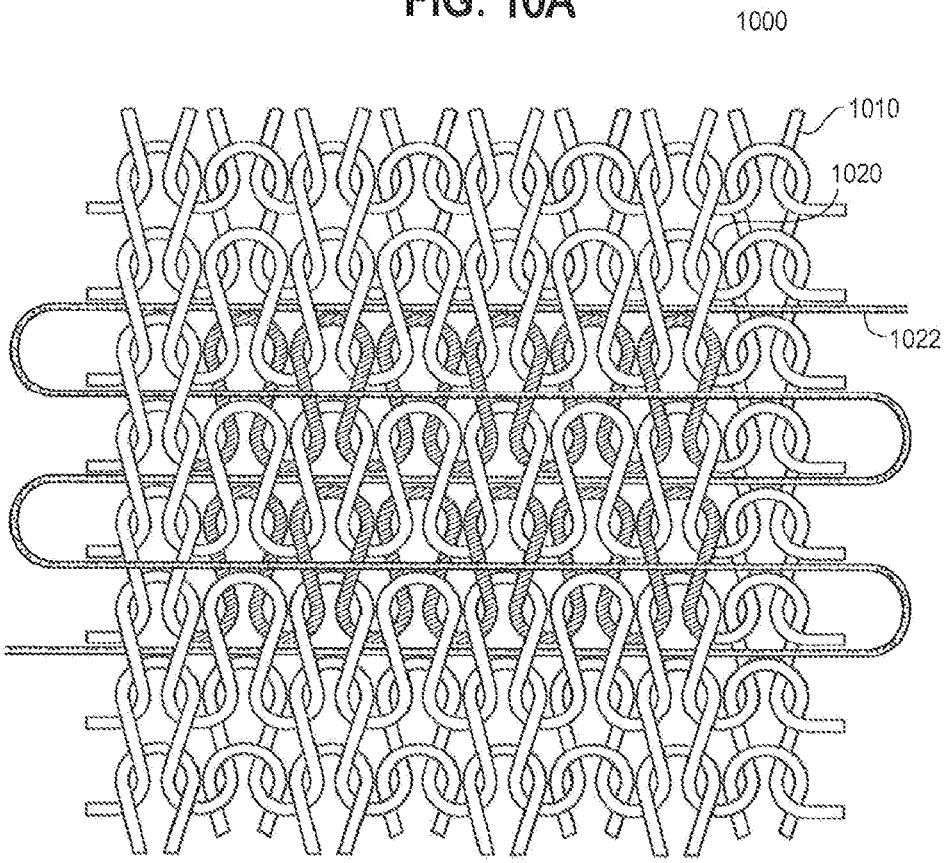
FIG. 10A: a front view of a rendering of a pre-processing knit textile with an inlayed yarn.

The textile 1000 may be a knitted structure comprising a first knit yarn 1010 and an inlayed yarn 1022 wherein the inlayed yarn 1022 is the yarn 100 as described above. In one embodiment, exemplified by FIG. 10A, the textile 1000 may be a knitted structure comprising a first knit yarn 1010 and a second knit yarn 1020 with an inlayed yarn 1022 wherein the inlayed yarn 1022 is the yarn 100 as described above.

III. Method of Processing a Textile

Described herein are methods of processing a textile 1000 described above to form a textile 1030 comprising any of the yarns 100 described above, wherein the yarn 100 is a strand comprising a thermoplastic material 110 comprising at least one thermoplastic polymer and a blowing agent. The processing causes the first thermoplastic material 110 to foam, forming at least one foamed area in the processed textile 1030.

The textile incorporating any of the yarns 100 may be processed to create one or more areas of multicellular foam 310 in the processed textile 1030. A multicellular foam is an expanded material having a cellular structure, i.e. having a plurality of cavities defined by the foamed material, resulting from introduction of gas bubbles during manufacture. An open-cell foam is a multicellular foam where the majority of cells are not fully encapsulated by the foamed material. A closed-cell foam is a multicellular foam where the majority of cells are not fully encapsulated by the foamed material. Once foamed, the multicellular foam areas 1040 of the processed textile 1030 have properties which differ from portions of the textile without the yarn 100, or portions in which the yarn 100 has not been foamed. For example, the foamed regions can impart increased texturing, cushioning, abrasion resistance, strength, lockout, or any combination of these properties, to the textile.

A first method of foaming an area of the textile 1000 comprises the steps of softening the first thermoplastic material 110, activating the blowing agent of the thermoplastic material of the yarn 100 to expand the softened thermoplastic material 110 into a multicellular foam 310, and solidifying the multicellular foam 310, forming one or more areas of multicellular foam 310 in the processed textile 1030. In some embodiments, the step of activating the blowing agent comprises exposing a portion of the textile 1000 containing the unprocessed yarn to a heat source, many of which are described above.

The molecular structure, amount, and reaction temperature of each ingredient determine the characteristics and subsequent use of the foam. Therefore, each formulation can be designed with a selection of ingredients to achieve multicellular foam having a variety of properties. For instance, the concentration and type of blowing agent and/or surfactant used can affect the cell size, rate of expansion, hardness and/or density of the multicellular foam. Similarly, the concentration and type of thermoplastic polymer(s) included in the thermoplastic material can affect the hardness and/or density of the multicellular foam.

The blowing agent used in the foaming step will, in part, dictate temperature and pressure ranges for processing. Blowing agents are discussed at length above.

In some embodiments, the step of activating the chemical blowing comprises raising the temperature of the first thermoplastic material 110 to about or above the activation temperature of the blowing agent. The step of raising the temperature may comprise exposing the yarn 100 or textile 1000 to a heating solid surface, a heating fluid, a form of actinic radiation, or a combination thereof. When the blowing agent is activated, the generation of the gas will cause the first thermoplastic material 110 to foam when the first thermoplastic material 110 is at a temperature where it is soft and deformable or fully melted.

After the first thermoplastic material 110 is expanded into a multicellular foam, the multicellular foam is solidified. In some embodiments of the method, the step of solidifying the foam comprises decreasing the temperature of the foamed thermoplastic material to a temperature below its deformation temperature.

In other embodiments of the method, the step of solidifying the foam comprises crosslinking the first thermoplastic material 110 to the point that the composition becomes a thermoset material. In embodiments where a crosslinking agent is used, the crosslinking agent can be initiated during the processing conditions used to process the textile. have an initiation temperature within the processing conditions used for the textile. For example, the cross-linking agent can be a thermally-activated cross-linking agent having an initiation temperature of the thermally-activated crosslinking agent can be near the initiation temperature of the blowing agent, so that the foaming and crosslinking occur simultaneously or nearly simultaneously. In this way, the first thermoplastic material 110 may remain soft enough to form a multicellular structure as the blowing agent is activated within the first thermoplastic material 110, but develops sufficient melt strength to maintain the multicellular structure without collapsing on itself, and cures into a solid multicellular foam having sufficient hardness.

As described above, if the first thermoplastic material 110 comprises a blowing agent that is thermally-activated, the blowing-agent activation temperature should be at about or above the melting temperature of the first thermoplastic material 110. As an example, if a thermoplastic material 110 has a melting temperature of about 90 degrees Celsius, and the blowing agent has an activation temperature of about 120 degrees Celsius or higher, the first thermoplastic material 110 would be in a molten state before the blowing agent begins to evolve gas to create the multicellular form structure. In such an instance, the textile or yarn may be processed in at or above about 120 degrees Celsius or above, including at or above about 145 degrees Celsius.

As described above, if the first thermoplastic material 110 comprises a cross-linking agent that is thermally-activated, the blowing-agent activation temperature should be at or above the activation temperature of the cross-linking agent so that the material will not fully cross-link the material during the step of softening the first thermoplastic material 110, but will initiate cross-linking at approximately the same temperature that the blowing agent begins expanding the material, or after the blowing agent begins expanding the material.

In some embodiments, the method of solidifying the multicellular foam 310 further comprises adhering the multicellular foam 310 to a surrounding portion of the textile. This step may comprise decreasing the temperature of the multicellular foam 310.

In some embodiments, during the foaming step, the material 110 may expand from about 10 percent to 2000 percent by volume, or from about 100 percent to about 1000 percent. During the foaming, the material 110 may expand from about 200 percent to about 700 percent by volume, or from about 300 percent to about 500 percent by volume.

In other embodiments, the method of processing the textile 1000 or yarn further comprises the step of molding the textile or yarn. In some embodiments, this step comprises applying a mold to the textile 1000. The step of applying the mold to the textile 1000 can be conducted before, during or after the foaming of the first thermoplastic material 110. In some instances, the mold may be a compression mold or slump mold. Although the mold may be at an ambient temperature, in other embodiments, the step of molding the textile or yarn may further comprise heating the mold. The step of heating may comprise exposing the mold to a heating solid surface, a heating fluid, electricity, actinic radiation, or a combination thereof. The temperature of the mold for processing the textile or yarn will vary depending on the desired characteristics of the foam as well as the blowing agent, processing pressure, and thermoplastic polymer. One possible range is between about 60 and 250 degrees Celsius. By molding the textile at a temperature at least 20 degrees Celsius above a temperature at which the textile is used is one way to allow the textile to maintain a molded shape during general use, wear, washing, drying, cleaning, and storage. This additional step of heating the mold may be performed after the applying the textile or yarn to the mold or before applying the textile or yarn to the mold.

Additionally, for instances where the textile is applied to a compression mold, the step of molding the textile may comprise applying additional pressure to the mold, i.e., pressure exceeding atmospheric pressure. Applying pressure to the mold can shape and/or restrict the foaming of the material 110, portion of the textile, creating a shaped foam and/or a denser foam. The amount of pressure applied will vary depending on the desired characteristics of the foam as well as the blowing agent, processing temperature, and thermoplastic polymer.

In other embodiments, the step of molding further comprises removing the foamed area or textile 1030 from the mold. The step of step of decreasing the temperature of the first thermoplastic material 110 can be performed before, during or after removing the textile from the mold.

Any of the methods of processing the textile 1000 above may include the additional step of impregnating a physical blowing agent into any of the yarns 100, wherein the impregnating is conducted prior to the steps of softening the first thermoplastic material 110, foaming the first thermoplastic material 110, and solidifying the multicellular foam 310. In such instances, the physical blowing agent may be chosen from a chlorofluorocarbon, a hydrochlorofluorocarbon, a hydrocarbon, an inert liquid, an inert gas, a supercritical fluid, or any of the other physical blowing agents previously described. In some embodiments, the physical blowing agent may comprise carbon dioxide where carbon dioxide is present in an amount of about 1% to about 3% or about 1% to about 5% by weight based on upon a total weight of thermoplastic material 110. Alternatively, the physical blowing agent may comprise nitrogen, where nitrogen is present in an amount of about 1% to about 3% or about 1% to about 5% by weight based upon a total weight of thermoplastic material 110.

The step of impregnating physical blowing agent into the thermoplastic material may further comprise dissolving or suspending the physical blowing agent in the first thermoplastic material 110. The impregnating may further comprise the steps of softening the first thermoplastic material 110 of the yarn, impregnating the softened thermoplastic material, and re-solidified the infused thermoplastic material of the yarn 100 prior to the step of softening the first thermoplastic material 110 and blowing the multicellular foam 310. The impregnating can comprise forming a single phase solution of the physical blowing agent in the first thermoplastic material 110, and solidifying the single phase solution under conditions effective to maintain the physical blowing agent in solution when solidified.

IV. A Processed Textile

Described herein is a processed textile 1030 comprising a multicellular foam 310. The multicellular foam 310 can be either-open celled or closed-cell, and can be the reaction product of foaming at least a portion of a yarn 100, wherein the yarn 100 is a strand comprising at least one thermoplastic material 110 comprising at least one thermoplastic polymer and a blowing agent.

A textile 1030 incorporating a multicellular foam may exhibit some of the advantageous properties of a fiber-based textiles, such as ease of manufacture, minimal waste, flexibility of design, variation of elasticity and thickness, ease of customization, and the like. Moreover, a textile 1030 incorporating multicellular foam 310 may exhibit some of the advantageous properties of foams, such as increased hardness, water resistance, moldability, rigidity, cushioning, sound dampening, mechanical dampening, among others.

In some embodiments, the multicellular foam 310 is a thermoplastic multicellular foam. For example, the thermoplastic multicellular foam may comprise a thermoplastic material which is the reaction product of a thermoplastic material 110 comprising a chemical blowing agent, wherein the reacted thermoplastic material comprises reacted chemical blowing agent. In other embodiments, the multicellular foam 310 may comprise a thermoset material which is the crosslinked reaction product of a thermoplastic material 110 comprising a blowing agent and a cross-linking agent.

The processed textile 1030 further comprises a first surface having a first surface texture, and a second surface, having a second surface texture. The first and second surface textures may or may not be similar. For example, the first surface may include foamed areas 1040 in which the foamed area 1040 has a greater height (i.e., sits proud of) the surrounding textile, and the second surface may be substantially flat. The processed textile 1030 may include unfoamed areas 1050 where the yarn 100 is not locally integrated into the textile 1030 or where there is no multicellular foam 310.

Figure 10B:
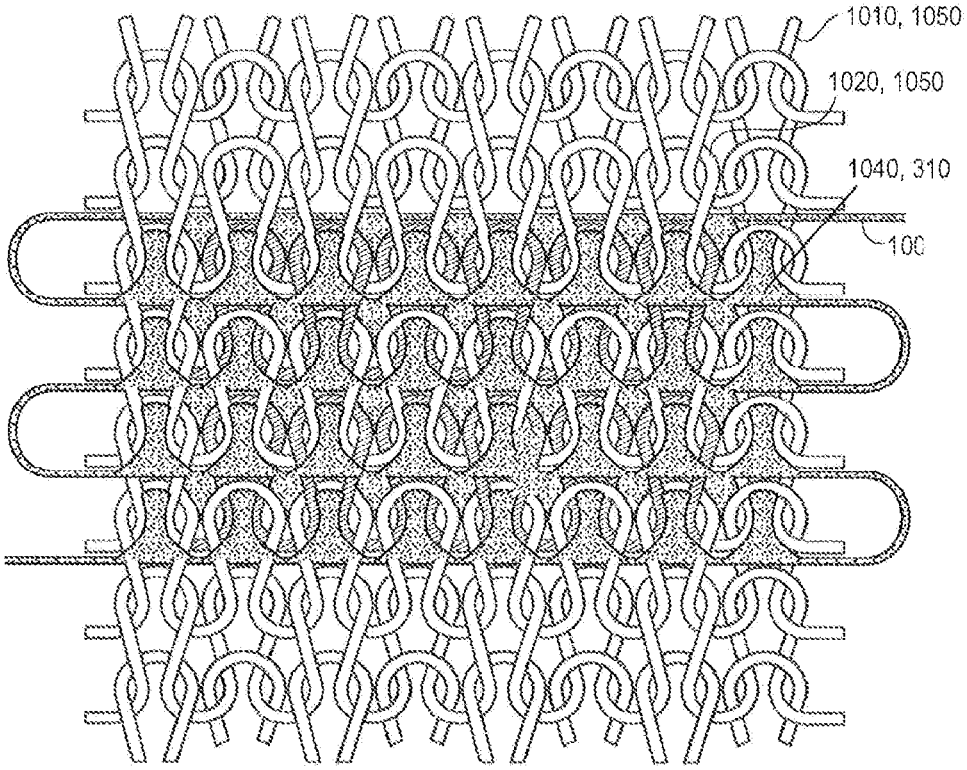
FIG. 10B: a front view of a rendering of a post-foaming knit textile with an inlayed yarn.

In some embodiments, and as depicted in FIG. 10B, the first surface texture comprises an area of continuous foam surface with little or no visible yarns 1040. This first surface may be bumpy, with smaller sub-areas where a depth of the foam is relatively thicker and smaller sub-areas where the foam is relatively thinner. These sub-areas of relatively thicker and relatively thinner foam may be regularly spaced or randomly distributed over the first surface. In other embodiments, the thickness of the foam may be about uniform so that the first surface texture is essentially smooth.

In other embodiments, the first surface texture comprises an area of discontinuous foam surface where sub-areas of foam are distributed between sub-areas of visible yarn. These sub-areas may be regularly spaced or randomly distributed over the first surface.

In some embodiments, the multicellular foam 310 has a hardness ranging from about 20 to 70 Asker C, or from about 30 to about 60 Asker C, or from about 40 to about 50 Asker C. However, depending on the desired properties of the multicellular foam 310, the hardness may be greater than 70 Asker C, or less than 20 Asker C. For example, if the foamed yarn is intended to provide cushioning, a softer foam may be desirable. If the foamed yarn is intended to provide abrasion resistance or act as a sacrificial layer, a harder foam may be desirable.

V. An Article Comprising the Yarn

Described herein are articles incorporating the processed textile 1030 or yarn 100 described above, comprising a multicellular foam 310. The multicellular foam 310 can be either-open celled or closed-cell, and can be the reaction product of foaming at least a portion of a yarn 100, wherein the yarn 100 is a continuous, flexible strand comprising a least one thermoplastic material 110 comprising at least one thermoplastic polymer and a blowing agent.

Figure 11A:
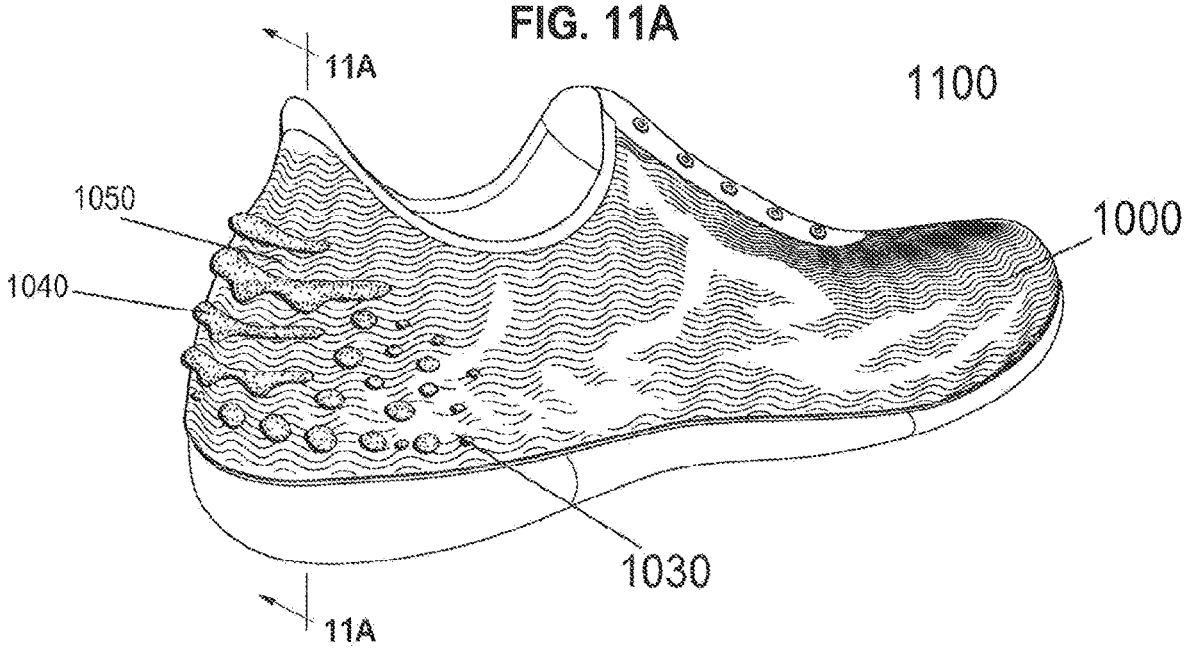
FIG. 11A: a side-view of an article of footwear incorporating a textile containing a foamable yarn after processing the textile to create foamed areas in the textile.
Figure 11B:
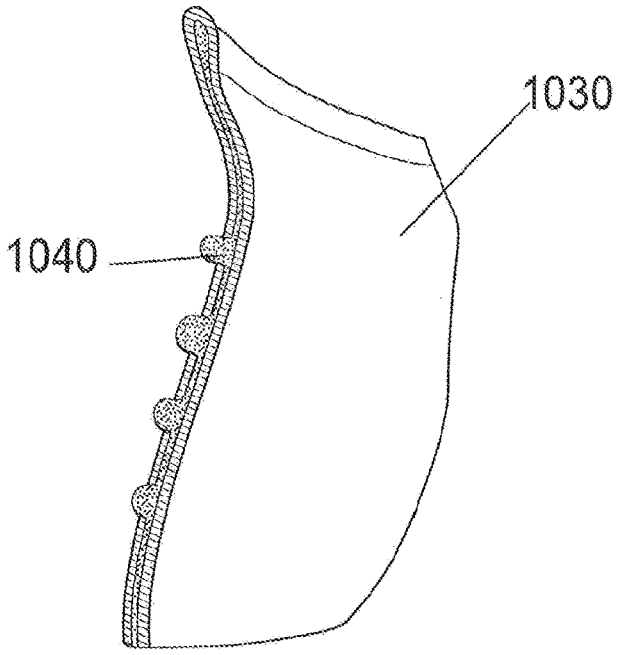
FIG. 11B: a cross-sectional rendering of a portion of the article in FIG. 11A.

Such articles may include an article of footwear, as exemplified in FIGS. 11A and 11B, or a portion of an article of such (such as an upper, a sole, a collar, a tongue, a heel, or other), an article of apparel or a portion of such, an article of sporting equipment or a portion of such. The article 1100 may include the textile 1000 with unfoamed areas 1050, or the textile 1030 with foamed areas 1040, or the textile 1030 with some combination of unfoamed areas 1050 and foamed areas 1040. Additionally, such articles may include or a grip element of the article, a cushioning element of the article, a sound dampening element of the article, a vibration dampening element of the article.

VI. Methods of Manufacturing Articles

Described herein are methods of manufacturing articles incorporating the textile 1030 or yarn 100 described above, comprising a multicellular foam 310.

A first method of manufacturing an article comprises the steps of affixing a first component to a second component, wherein the first component includes a textile 1030 or 1040 as described above.

For the purposes of this disclosure, "consisting essentially of" permits inclusion of components not enumerated, provided that they do not materially affect the basic properties or characteristics of the disclosure. For example, the basic properties or characteristics can be determined using standard tests, such as standard tests of physical properties, known to one of ordinary skill in the art. Depending on the property, alteration of the property by at least 1 percent or by at least 2 percent or by at least 5 percent may be considered a material effect. Alternatively or additionally, the presence of at least 1 weight percent or at least 2 weight percent or at least 5 weight percent of impurities or other materials may be considered to materially alter a composition. These are examples and not to be considered as a finite list of properties or methods where this terminology may apply.

While various embodiments have been described, it will be apparent to those of ordinary skill in the art that many more embodiments and implementations are possible. Accordingly, the embodiments described herein are examples, not the only possible embodiments and implementations.

The subject matter of the disclosure may also relate to the following aspects:

A first aspect relates to a yarn comprising: a first thermoplastic material comprising a blowing agent and at least one at least one thermoplastic polymer.

A second aspect relates to the yarn of the first aspect, wherein the at least one thermoplastic polymer comprises one or more thermoplastic polymers chosen from a thermoplastic polyurethane; a thermoplastic polyolefin; a thermoplastic polyester; a thermoplastic polyether, a thermoplastic polyamide; or any combination thereof.

A third aspect relates to the yarn of the second aspect, wherein the thermoplastic polyurethane comprises a thermoplastic polyester-polyurethane copolymer.

A fourth aspect relates to the yarn of the second aspect, wherein the thermoplastic polyester comprises a thermoplastic polyethylene terephtalate.

A fifth aspect relates to the yarn of the second aspect, wherein the thermoplastic polyolefin comprises a thermoplastic polyethylene.

A sixth aspect relates to the yarn of the fifth aspect, wherein the thermoplastic polyethylene comprises a thermoplastic ethylene-vinyl acetate copolymer.

A seventh aspect relates to the yarn of the second aspect, wherein the thermoplastic polyolefin comprises a polypropylene.

An eighth aspect relates to the yarn of any preceding aspect, wherein the at least one thermoplastic polymer comprises a thermoplastic polyamide.

A ninth aspect relates to the yarn of the eighth aspect, wherein the thermoplastic polyamide comprises Nylon 6, Nylon 11, Nylon 6,6, or any combination thereof.

A tenth aspect relates to the yarn of any preceding aspect, wherein the first thermoplastic material is a thermosetting thermoplastic material.

An eleventh aspect relates to the yarn of any preceding aspect, wherein the first thermoplastic material comprises a cross-linking agent.

A twelfth aspect relates to the yarn of any preceding aspect, wherein the cross-linking agent comprises a bifunctional cross-linking agent.

A thirteenth aspect relates to the yarn of the eleventh or twelfth aspect, wherein the cross-linking agent comprises a thermally-activated or UV light-activated cross-linking agent, optionally wherein the cross-linking agent is a thermally-activated cross-linking agent, optionally wherein the cross-linking agent consists of one or more thermally-activated cross-linking agent.

A fourteenth aspect relates to the yarn of any preceding aspect, wherein the first thermoplastic material includes one or more additional components chosen from a colorant; an ultraviolet light absorber; an antioxidant; a processing aid; a plasticizer, an emulsifier, an optical brightener, a rheology modifier, a catalyst, a cross-linking agent, including a cross-linking agent, a halogen scavenger, a smoke inhibitor, an antistatic agent, a filler, an odorant, an deodorant, or any combination thereof.

A fifteenth aspect relates to the yarn of the fourteenth aspect, wherein the additional component comprises a cross-linking agent.

A sixteenth aspect relates to the yarn of the fifteenth aspect, wherein the cross-linking agent is thermally activated.

A seventeenth aspect relates to the yarn of any preceding aspect, wherein the thermoplastic material includes a thermoplastic polymeric component consisting of all thermoplastic polymers present in the thermoplastic material, and the thermoplastic polymeric component comprises at least 15 weight percent of a total weight of the thermoplastic material.

An eighteenth aspect relates to the yarn of any preceding aspect, wherein the blowing agent comprises a physical blowing agent.

A nineteenth aspect relates to the yarn of the eighteenth aspect, wherein the physical blowing agent is chosen from a fluorocarbon; a hydrocarbon; an inert gas; an inert liquid; a supercritical fluid; or any combination thereof.

A twentieth aspect relates to the yarn of the eighteenth or nineteenth aspect, wherein the physical blowing agent includes a supercritical fluid.

A twenty-first aspect relates to the yarn of any of the eighteenth through the twentieth aspects, wherein the physical blowing agent comprises supercritical nitrogen.

A twenty-second aspect relates to the yarn of any of the eighteenth through the twenty-first aspects, wherein the physical blowing agent comprises supercritical carbon dioxide.

A twenty-third aspect relates to the yarn of any of the eighteenth through the twenty-second aspects, wherein carbon dioxide is present in an amount of about 1 percent to about 3 percent or about 1 percent to about 5 percent by weight based on upon a total weight of the thermoplastic material.

A twenty-fourth aspect relates to the yarn of any of the eighteenth through the twenty-third aspects, wherein nitrogen is present in an amount of about 1 percent to about 3 percent or about 1 percent to about 5 percent by weight based on upon a total weight of the thermoplastic material.

A twenty-fifth aspect relates to the yarn of any of the first through the fourteenth aspects, wherein the blowing agent comprises a chemical blowing agent, optionally wherein the blowing agent is a chemical blowing agent, optionally wherein the blowing agent consists of one or more chemical blowing agents.

A twenty-sixth aspect relates to the yarn of the twenty-fifth aspect, wherein the chemical blowing agent is a thermally-activated chemical blowing agent.

A twenty-seventh aspect relates to the yarn of the twenty-fifth or twenty-sixth aspect, the chemical blowing agent is chosen from sodium bicarbonate, ammonium carbonate, ammonium bicarbonate, calcium azide, azodicarbonamide, hydrazocarbonamide, benzenesulfonyl hydrazide, dinitrosopentamethylene tetramine, toluenesulfonyl hydrazide, p,p'-oxybis(benzenesulfonylhydrazide), azobisisobutyronitrile, barium azodicarboxylate, or any combination thereof.

A twenty-eighth aspect relates to the yarn of any preceding aspect, wherein the blowing agent is present in the first thermoplastic material in an amount effective to foam the first thermoplastic material into a multicellular foam structure.

A twenty-ninth aspect relates to the yarn of the twenty-eighth aspect, wherein the blowing agent is a thermally activated blowing agent.

A thirtieth aspect relates to the yarn of any preceding aspect, further comprising a core comprising a core material, wherein the core is at least partially surrounded by the first thermoplastic material.

A thirty-first aspect relates to the yarn of the thirtieth aspect, wherein the core is fully surrounded by the first thermoplastic material.

A thirty-second aspect relates to the yarn of the thirtieth or thirty-first aspect, wherein the core material comprises a conductive material.

A thirty-third aspect relates to the yarn of any of the thirtieth through the thirty-second aspects, wherein the conductive material comprises a metal.

A thirty-fourth aspect relates to the yarn of any one of the thirtieth through the thirty-third aspects, wherein the core material comprises one or more polymers chosen from a thermoplastic polyurethane; a thermoplastic polyolefin; a thermoplastic polyester; a thermoplastic polyether, a thermoplastic polyamide; or any combination thereof.

A thirty-fifth aspect relates to the yarn of any one of the thirtieth through the thirty-fourth aspects, wherein the core comprises one or more fibers or filaments, wherein the one or more fibers or filaments is chosen from a natural fiber or filament, a regenerated fiber or filament, a synthetic fiber or filament, or any combination thereof.

A thirty-sixth aspect relates to the yarn of any one of the thirtieth through the thirty-fifth aspects, wherein the core material is a second thermoplastic material having a softening temperature at least 5 degrees Celsius above a melting temperature of the first thermoplastic material.

A thirty-seventh aspect relates to the yarn of the thirty-sixth aspect, wherein the second thermoplastic material has a softening temperature at least 10 degrees Celsius above the melting temperature of the first thermoplastic material.

A thirty-eighth aspect relates to the yarn of the thirty-seventh aspect, wherein the second thermoplastic material has a softening temperature at least 20 degrees Celsius above the melting temperature of the first thermoplastic material.

A thirty-ninth aspect relates to the yarn of any one of the thirtieth through the thirty-eighth aspects, wherein the core has a percent elongation of less than 30 percent, or of less than 25 percent, or from about 5 percent to about 25 percent.

A fortieth aspect relates to the yarn of any one of the thirtieth through the thirty-ninth aspects, wherein the core has a breaking strength of at least 1.5 kilograms force per centimeter squared, or from about 1.5 to about 10 kilograms force per centimeter squared.

A forty-first aspect relates to the yarn of any one of the thirtieth through the fortieth aspects, wherein the core has a linear mass density from about 60 to about 70,000 denier, from about 100 to about 1,000 denier, or from about 150 to about 500 denier.

A forty-second aspect relates to the yarn of any one of the thirtieth through the forty-first aspects, wherein the core has a tenacity from about 1.5 to about 10.0 grams per denier, or from about 1.5 to about 4.0 grams per denier, or from about 2.5 to about 4.0 grams per denier.

A forty-third aspect relates to the yarn of any one of the thirtieth through the forty-second aspects, wherein the core includes a core yarn.

A forty-fourth aspect relates to the yarn of the forty-third aspect, wherein the core yarn comprises a plurality of fibers or filaments, optionally wherein the core yarn is at least one of a spun yarn, a twisted yarn, and an entangled yarn.

A forty-fifth aspect relates to the yarn of the forty-third aspect, wherein the core yarn is a monofilament yarn.

A forty-sixth aspect relates to the yarn of any one of the thirtieth through the forty-fifth aspects, further comprising a coating, comprising the first thermoplastic material that is coaxial to the core.

A forty-seventh aspect relates to the yarn of any one of the thirtieth through the forty-sixth aspects, wherein the core comprises at least one filament, and the at least one filament is at least partially surrounded by the first thermoplastic material.

A forty-eighth aspect relates to the yarn of any preceding aspect, wherein the first thermoplastic material has a melting temperature from about 50 degrees Celsius to about 145 degrees Celsius.

A forty-ninth aspect relates to the yarn of the forty-eighth aspect, wherein the first thermoplastic melting temperature is about 85 degrees Celsius.

A fiftieth aspect relates to the yarn of any preceding aspect, wherein the chemical blowing agent has an activation temperature that is at or above a melting temperature of the first thermoplastic material.

A fifty-first aspect relates to the yarn of the fiftieth aspect, wherein the activation temperature of the blowing agent is at least about 5 degrees Celsius above the melting temperature of the first thermoplastic material.

A fifty-second aspect relates to the yarn of the fifty-first aspect, the activation temperature of the blowing agent is at least about 10 degrees Celsius above the melting temperature of the first thermoplastic material.

A fifty-third aspect relates to the yarn of the fifty-second aspect, wherein the activation temperature of the blowing agent is at least about 20 degrees above the melting temperature of the first thermoplastic material.

A fifty-fourth aspect relates to the yarn of the fifty-third aspect, wherein the activation temperature of the blowing agent is at least about 60 degrees above the melting temperature of the first thermoplastic material.

A fifty-fifth aspect relates to the yarn of any one of the thirtieth through the fifty-fourth aspects, wherein the core has a cross-sectional diameter and the first thermoplastic material at least partially surrounding the core has an average thickness such that the cross-sectional diameter of the core is at least 3 times smaller than the average thickness of the coating, wherein the first thermoplastic material is an unfoamed thermoplastic material.

A fifty-sixth aspect relates to the yarn of any one of the thirtieth through the fifty-fifth aspects, wherein the core has a cross-sectional diameter and the first thermoplastic material at least partially surrounding the core has an average thickness such that the average thickness of the coating is at most 10 times larger than the cross-sectional diameter of the core, wherein the first thermoplastic material is an unfoamed thermoplastic material.

A fifty-seventh aspect relates to the yarn of any one of the thirtieth through the fifty-sixth aspects, wherein the first thermoplastic material at least partially surrounding the core has an average thickness from about 0.4 millimeters to about 3.0 millimeters A fifty-eighth aspect relates to the yarn of any preceding aspect, wherein the yarn has an average cross-sectional diameter of less than about 4.0 millimeters.

A fifty-ninth aspect relates to the yarn of any one of the thirtieth though the fifty-eighth aspects, wherein the thermoplastic material comprises thermoplastic ethylene-vinyl acetate and a thermally-activated chemical blowing agent, and a thermally activated cross-linking agent.

A sixtieth aspect relates to the yarn of the fifty-ninth aspect, wherein the core material comprises a polyester.

A sixty-first aspect relates to the yarn of the fifty-ninth or the sixtieth aspect, wherein the core comprises an entangled multi-filament yarn.

A sixty-second aspect relates to a method for making a yarn, the method comprising: forming a yarn, wherein the yarn comprises a first thermoplastic material, the first thermoplastic material comprising one or more thermoplastic polymers and a blowing agent.

A sixty-third aspect relates to the method of the sixty-second aspect, wherein the yarn is a yarn according to any one of the first to sixty-second aspects.

A sixty-fourth aspect relates to the method of the sixty-second or sixty-third aspect, wherein forming the yarn comprises coating a core with the first thermoplastic material, optionally wherein the core is a core yarn.

A sixty-fifth aspect relates to the method of any one of the sixty-second through sixty-fourth aspects, wherein forming the yarn comprises extruding the first thermoplastic material.

A sixty-sixth aspect relates to the method of any one of the sixty-second through the sixty-fifth aspects, wherein the step of forming the yarn further comprises increasing a temperature of the first thermoplastic material to a temperature at or above a melting temperature of the first thermoplastic material but at least 5 degrees Celsius below an activation temperature of the blowing agent.

A sixty-seventh aspect relates to the method of the sixty-fourth aspect, wherein coating the core further comprises pulling the core through a molten first thermoplastic material.

A sixty-eighth aspect relates to the method of the sixty-seventh aspect, wherein pulling the core through the molten first thermoplastic material comprises pulling the core yarn through a bath of a first thermoplastic material in a molten state, optionally wherein the core is a core yarn.

A sixty-ninth aspect relates to the method of the sixty-seventh aspect, wherein pulling the core through the molten first thermoplastic material comprises pulling the core yarn through a port in an extruder containing the first thermoplastic material in a molten state, optionally wherein the core is a core yarn.

A seventieth aspect relates to a yarn made by the method of any one of the sixty-second through the sixty-ninth aspects.

A seventy-first aspect relates to a textile comprising a first yarn, the first yarn comprising a first thermoplastic material, the first thermoplastic material comprising a blowing agent and one or more thermoplastic polymers, optionally wherein the first yarn comprises a core.

A seventy-second aspect relates to a textile comprising the yarn of any one of the first through sixty-first aspects or the seventieth aspect.

A seventy-third aspect relates to the textile of the seventy-first or seventy-second aspect, wherein the textile is chosen from a knitted textile, a woven textile, a crocheted textile, a braided textile, a tatted textile, a non-woven textile, or a combination thereof.

A seventy-fourth aspect relates to the textile of the seventy-first or seventy-second aspect, wherein the textile comprises an embroidered region further comprising the yarn of any one of the first through sixty-first aspects or the seventieth aspect.

A seventy-fifth aspect relates to the textile of any of the seventy-first through the seventy-fourth aspects, further comprising a second yarn.

A seventy-sixth aspect relates to the textile of the seventy-fifth aspect, wherein the textile further comprises a second yarn, and the first yarn and the second yarn are in contact with each other.

A seventy-seventh aspect relates to a textile comprising: a multicellular foam, wherein the multicellular foam is the reaction product of foaming at least a portion of a first yarn, wherein the first yarn is the yarn of any one of the first through sixty-first aspects or the seventieth aspect, optionally wherein the first yarn comprises a core.

A seventy-eighth aspect relates to the textile of the seventieth-seventh aspect, wherein the multicellular foam is an open-celled multicellular foam.

A seventy-ninth aspect relates to the textile of the seventy-seventh aspect, wherein the multicellular foam is a closed-celled multicellular foam.

An eightieth aspect relates to the textile of any one of the seventy-seventh through the seventy-ninth aspects, wherein the multicellular foam comprises a third material comprising a reacted chemical blowing agent, optionally wherein the third material is a foamed product of a second thermoplastic material comprising one or more polymers and a chemical blowing agent, optionally wherein the chemical blowing agent is a thermally-activated chemical blowing agent.

An eighty-first aspect relates to the textile of the eightieth aspect, wherein the third material is a thermoplastic material.

An eighty-second aspect relates to the textile of the eightieth aspect, wherein the third material is a thermoformable material.

An eighty-third aspect relates to the textile of the eightieth aspect, wherein the third material is a thermoset material.

An eighty-fourth aspect relates to the textile of any one of the eightieth through the eighty-third aspects, wherein the third material is a cross-linked product of a second thermoplastic material comprising one or more polymers and a cross-linking agent, optionally wherein the cross-linking agent is a thermally-activated cross-linking agent.

An eighty-fifth aspect relates to the textile of the eighty-fourth aspect, wherein the cross-linking agent is a thermally-activated cross-linking agent, and the cross-linked product is partially cross-linked.

An eighty-sixth aspect relates to the textile of any one of the seventy-seventh through the eighty-third aspects, wherein the textile is chosen from a knitted textile, a woven textile, a crocheted textile, a braided textile, a tatted textile, a non-woven textile, or a combination thereof.

An eighty-seventh aspect relates to a method for processing an article, the method comprising the steps of: increasing a temperature of a first yarn of any one of the first through the forty-eight aspects or the fifty-seventh aspect, to a temperature at or above a softening temperature of the first thermoplastic material of the first yarn, or to a temperature at or above a melting temperature of the first thermoplastic material; while the temperature of the first yarn is at or above the softening or melting temperature of the first thermoplastic material, activating the blowing agent, thereby foaming at least a portion of the first thermoplastic material of the first yarn into a multicellular foam, and solidifying the multicellular foam, optionally wherein the first yarn comprises a core.

An eighty-eighth aspect relates to the method of the eighty-seventh aspect, wherein the step of solidifying further comprises adhering the multicellular foam to a surrounding portion of the textile.

An eighty-ninth aspect relates to the method of the eighty-seventh or the eighty-eighth aspect, wherein the step of solidifying the multicellular foam comprises decreasing the temperature of the multicellular foam.

A ninetieth aspect relates to the method of the eighty-ninth aspect, wherein decreasing the temperature comprises cooling the multicellular foam at ambient temperature.

A ninety-first aspect relates to the method of the eighty-ninth aspect, wherein the step of decreasing the temperature further comprises quenching the multicellular foam with a liquid.

A ninety-second aspect relates to the method of the eighty-ninth aspect, wherein the step of decreasing the temperature further comprises exposing the multicellular foam to a gas.

A ninety-third aspect relates to the method of the eighty-ninth aspect, wherein the step of decreasing the temperature further comprises placing at least the portion of the textile comprising the multicellular foam in contact with a surface.

A ninety-fourth aspect relates to the method of any of the eighty-seventh through the ninety-third aspects, wherein the step of increasing the temperature of the first yarn comprises exposing the textile to a heat source.

A ninety-fifth aspect relates to the method of the ninety-fourth aspect, wherein the heat source is a convection heat source.

A ninety-sixth aspect relates to the method of the ninety-fourth aspect, wherein the heat source is a direct heat source.

A ninety-seventh aspect relates to the method of the ninety-fourth aspect, wherein the heat source is an indirect heat source.

A ninety-eighth aspect relates to the method of the ninety-fourth aspect, wherein the heat source is an oven.

A ninety-ninth aspect relates to the method of the ninety-fourth aspect, wherein the direct heat source is a liquid, optionally wherein the direct heat source is a liquid bath.

A one-hundredth aspect relates to the method of the ninety-sixth aspect, wherein the direct heat source is a surface.

A one hundred and first aspect relates to the method of the ninety-sixth aspect, wherein the direct heat source is a surface.

A one hundred and second aspect relates to the method of any one of the eighty-seventh through the one hundred and first aspects, wherein the step of foaming the first thermoplastic material comprises exposing the first yarn to actinic radiation.

A one hundred and third aspect relates to the method of the one hundred and second aspect, wherein the actinic radiation is chosen from microwave radiation, radio wave radiation, electron beam radiation, gamma beam radiation, infrared radiation, ultraviolet light, visible light, or a combination thereof.

A one hundred and fourth aspect relates to the method of any one of the eighty-seventh through the one hundred and third aspects, further comprising the step of molding the textile.

A one hundred and fifth aspect relates to the method of the one hundred and fourth aspect, wherein molding the textile comprises applying a mold to the textile.

A one hundred and sixth aspect relates to the method of the one hundred and fifth aspect, wherein the mold is a slump mold.

A one hundred and seventh aspect relates to the method of the one hundred and fifth aspect, wherein the mold is a compression mold.

A one hundred and eighth aspect relates to the method of any one of the one hundred and fifth through the one hundred and seventh aspects, further comprising the step of increasing a temperature of the mold.

A one hundred and ninth aspect relates to the method of the one hundred and eighth aspect, wherein the step of increasing a temperature of the mold is performed after applying the mold to the textile.

A one hundred and tenth aspect relates to the method of the one hundred and eighth aspect, wherein the step of increasing a temperature of the mold is performed before applying the mold to the textile.

A one hundred and eleventh aspect relates to the method of any one of the one hundred and eighth to the one hundred and tenth aspects, wherein the step of increasing a temperature of the mold further comprises increasing a temperature of the mold to at least 135 degrees Celsius.

A one hundred and twelfth aspect relates to the method of any one of the one hundred and fifth through the one hundred and eleventh aspects, further comprising the step of removing the textile from the mold following the step of solidifying the multicellular foam.

A one hundred and thirteenth aspect relates to the method of the one hundred and twelfth aspect, wherein the step of decreasing the temperature of the first thermoplastic material is performed before or during the step of removing the textile from the mold.

A one hundred and fourteenth aspect relates to the method of the one hundred and thirteenth aspect, wherein the step of decreasing the temperature of the first thermoplastic material is performed after removing the textile from the mold.

A one hundred and fifteenth aspect relates to the method of any one of the eighty-seventh through the one hundred and fourteenth aspects, further comprising the step of infusing a physical blowing agent into the yarn, wherein the infusing is conducted prior to the steps of softening the first thermoplastic material, foaming the first thermoplastic material, and solidifying the multicellular foam.

A one hundred and sixteenth aspect relates to the method of the one hundred and fifteenth aspect, wherein the physical blowing agent is chosen from a fluorocarbon; a hydrocarbon; an inert gas; an inert liquid; a supercritical fluid; or any combination thereof.

A one hundred and seventeenth aspect relates to the method of the one hundred and sixteenth aspect, wherein the physical blowing agent includes a supercritical fluid.

A one hundred and eighteenth aspect relates to the method of the one hundred and seventeenth aspect, wherein the supercritical fluid comprises supercritical nitrogen.

A one hundred and nineteenth aspect relates to the method of the one hundred and seventeenth aspect, wherein the supercritical fluid comprises supercritical carbon dioxide.

A one hundred and twentieth aspect relates to the method of the one hundred and nineteenth aspect, wherein the supercritical carbon dioxide is present in an amount of about 1 percent to about 3 percent or about 1 percent to about 5 percent by weight based on upon a total weight of thermoplastic material.

A one hundred and twenty-first aspect relates to the method of the one hundred and eighteenth aspect, wherein the supercritical nitrogen is present in an amount of about 1 percent to about 3 percent or about 1 percent to about 5 percent by weight based on upon a total weight of the thermoplastic material.

A one hundred and twenty-second aspect relates to the method of the one hundred fifteenth aspect, wherein the infusing comprises dissolving or suspending the physical blowing agent in the first thermoplastic material.

A one hundred and twenty-third aspect relates to the method of the one hundred and twenty-second aspect, further comprising the steps of softening the thermoplastic material before the step of dissolving or suspending the physical blowing agent in the first thermoplastic material.

A one hundred and twenty-fourth aspect relates to the method of the one hundred and twenty-second or one hundred and twenty-third aspect, wherein the infusing comprises adding the physical blowing agent to a molten first thermoplastic material, forming a single phase solution of the physical blowing agent in the first at least one thermoplastic material, and solidifying the single phase solution under conditions effective to maintain the physical blowing agent in solution when solidified.

A one hundred and twenty-fifth aspect relates to the method of the one hundred and twenty-fourth aspect, wherein the infusing comprises infusing a solid first thermoplastic material with the physical blowing agent to form infused solid first thermoplastic material.

A one hundred and twenty-sixth aspect relates to a textile made by the method of any one of the eighty-seventh through the one hundred and twenty-fifth aspects.

A one hundred and twenty-seventh aspect relates to an article comprising: a textile comprising a first yarn, the first yarn comprising a first thermoplastic material, the first thermoplastic material comprising a blowing agent and one or more thermoplastic polymers, optionally wherein the first yarn comprises a core.

A one hundred and twenty-eighth aspect relates to an article comprising: a textile comprising the first yarn of any one of the first through the sixty-first aspects or the seventieth aspect.

A one hundred and twenty-ninth aspect relates to an article comprising: a first yarn, the first yarn comprising a first thermoplastic material, the first thermoplastic material comprising a blowing agent and one or more at least one thermoplastic polymer.

A one hundred and thirtieth aspect relates to an article comprising: the first yarn of any one of the first through the fifty-third aspects or the sixty-second aspect.

A one hundred and thirty-first aspect relates to an article comprising: a textile comprising a multicellular foam, wherein the multicellular foam is the reaction product of foaming at least a portion of a first yarn, the first yarn comprising a first thermoplastic material, the first thermoplastic material comprising a blowing agent and one or more thermoplastic polymers, optionally wherein the first yarn comprises a core.

A one hundred and thirty-second aspect relates to the article of the one hundred and thirty-first aspect, wherein the textile is a textile according to any one of the seventy-seventh through the eighty-third aspects.

A one hundred and thirty-third aspect relates to the article of the one hundred and thirty-second aspect, wherein the multicellular foam has a hardness from about 30 to about 60 as measured on an Asker C durometer.

A one hundred and thirty-fourth aspect relates to the article of the one hundred and thirty-third aspect, wherein the multicellular foam has a hardness from about 40 to about 50 measured on an Asker C durometer.

A one hundred and thirty-fifth aspect relates to the article of any one of one hundred twenty-seventh through the one hundred and thirty-fourth aspects, wherein the article is an article of footwear.

A one hundred and thirty-sixth aspect relates to the article of any one of one hundred twenty-seventh through the one hundred and thirty-fourth aspects, wherein the article is an article of apparel.

A one hundred and thirty-seventh aspect relates to the article of any one of one hundred twenty-seventh through the one hundred and thirty-fourth aspects, wherein the article is an article of sporting equipment.

A one hundred and thirty-eighth aspect relates to the article of any one of one hundred twenty-seventh through the one hundred and thirty-fourth aspects, wherein the textile is a grip element of the article.

A one hundred and thirty-ninth aspect relates to the article of any one of one hundred twenty-seventh through the one hundred and thirty-fourth aspects, wherein the textile is a cushioning element of the article.

A one hundred and fortieth aspect relates to the article of any one of one hundred twenty-seventh through the one hundred and thirty-fourth aspects, wherein the textile is sound dampening element of the article.

A one hundred and forty-first aspect relates to the article of any one of one hundred twenty-seventh through the one hundred and thirty-fourth aspects, wherein the textile is a vibration dampening element of the article.

A one hundred and forty-second aspect relates to a method of manufacturing an article, the method comprising: affixing a first component to a second component, wherein the first component includes a textile according to any one of the seventy-first to eighty-sixth aspects.

A one hundred and forty-third aspect relates to the method of the one hundred and forty-second aspect, wherein the first component is an upper for an article of footwear, and the second component is a sole structure for an article of footwear.

A one hundred and forty-fourth aspect relates to a yarn comprising: a core yarn comprising a plurality of fibers or filaments, each of the plurality of fibers or filaments comprising a core material; and a first thermoplastic material forming an unfoamed coating at least partially surrounding the core yarn; wherein the first thermoplastic material comprises at least one first thermoplastic polymer chosen from a thermoplastic polyurethane, a thermoplastic polyolefin, a thermoplastic polyester, a thermoplastic polyether, a thermoplastic polyamide, or any combination thereof; and a thermally-activated chemical blowing agent, wherein the thermally-activated chemical blowing agent is present in the first thermoplastic material in an amount effective to foam the unfoamed coating of the first thermoplastic material into a multicellular foam.

A one hundred and forty-fifth aspect relates to the yarn of the one hundred and forty-fourth aspect, wherein the first thermoplastic material comprises the thermoplastic polyolefin, and the thermoplastic polyolefin comprises an ethylene-vinyl acetate copolymer.

A one hundred and forty-sixth aspect relates to a yarn of the one hundred and forty-fourth or forty-fifth aspect, wherein the first thermoplastic material further comprises a cross-linking agent.

A one hundred and forty-seventh aspect relates to the yarn of any one of the one hundred and forty-fourth through the one hundred and forty-sixth aspects, wherein the core material comprises a second thermoplastic material, and the second thermoplastic material comprises one or more polymers chosen from a thermoplastic polyurethane; a thermoplastic polyolefin; a thermoplastic polyester; a thermoplastic polyether, a thermoplastic polyamide; or any combination thereof.

A one hundred and forty-eighth aspect relates to the yarn of the one hundred and forty-seventh aspect, wherein the second thermoplastic material comprises the thermoplastic polyester.

A one hundred and forty-ninth aspect relates to the yarn of the one hundred and forty-seventh aspect, wherein the second thermoplastic material has a softening temperature at least 20 degrees Celsius above a melting temperature of the first thermoplastic material.

A one hundred and fiftieth aspect relates to the yarn of any one of the one hundred and forty-fourth to the one hundred and forty-ninth aspects, wherein the core yarn has a percent elongation of from about 5 percent to about 25 percent.

A one hundred and fiftieth aspect relates to the yarn of the one hundred and forty-fourth to the one hundred and fiftieth aspects, wherein the core yarn has a breaking strength from about 1.5 to about 10 kilograms force per centimeter squared.

A one hundred and fifty-first aspect relates to the yarn of any one of the one hundred and forty-fourth to the one hundred and fiftieth aspects, wherein the core yarn has a tenacity from about 1.5 to about 10.0 grams per denier.

A one hundred and fifty-second aspect relates to the yarn of any one of the one hundred and forty-fourth to the one hundred and fifty-first aspects, wherein the core yarn is a twisted multi-filament yarn or an entangled multi-filament yarn.

A one hundred and fifty-third aspect relates to the yarn of any one of the one hundred and forty-fourth to the one hundred and fifty-second aspects, the yarn of any one of claims 1 to 10 wherein the first thermoplastic material at least partially surrounding the core yarn has an average thickness of from about 0.4 millimeters to about 3.0 millimeters.

A one hundred and fifty-fourth aspect relates to the yarn of any one of the one hundred and forty-fourth to the one hundred and fifty-third aspects, wherein the yarn has an average cross-sectional diameter of less than 4 millimeters.

A one hundred and fifty-fifth aspect relates to the yarn of any one of the one hundred and forty-fourth to the one hundred and fifty-fifth aspects, wherein the core yarn has a cross-sectional diameter, and the first thermoplastic material at least partially surrounding the core yarn is coaxial with the core yarn and has an average thickness at most 10 times larger than the cross-sectional diameter of the core yarn.

A one hundred and fifty-sixth aspect relates a method for making a yarn, the method comprising: applying a coating of a first thermoplastic material to a core yarn to at least partially surround the core yarn with an unfoamed coating of the first thermoplastic material; wherein the core yarn comprises a plurality of fibers or filaments, and each of the plurality of fibers or filaments comprises a core material; and wherein the first thermoplastic material comprises at least one first thermoplastic polymer chosen from a thermoplastic polyurethane, a thermoplastic polyolefin, a thermoplastic polyester, a thermoplastic polyether, a thermoplastic polyamide, or any combination thereof; and a thermally-activated chemical blowing agent, wherein the thermally-activated chemical blowing agent is present in the first thermoplastic material in an amount effective to foam the first thermoplastic material into a multicellular foam structure.

A one hundred and fifty-seventh aspect relates the method of the one hundred and fifty-sixth aspect, wherein, during the applying, the first thermoplastic material is at a first coating temperature at or above a melting temperature of the first thermoplastic material but at least 20 degrees Celsius below an activation temperature of the blowing agent and, when the core material is a second thermoplastic material, the first coating temperature is at least 20 degrees Celsius below a softening temperature of the core material.

A one hundred and fifty-eighth aspect relates the method of the one hundred and fifty-sixth or one hundred and fifty-seventh aspect, wherein applying the coating of the first thermoplastic material to the core yarn comprises increasing a temperature of the first coating thermoplastic material to the first temperature to form molten first thermoplastic material; extruding the molten first thermoplastic material onto the core yarn; and decreasing a temperature of the molten first thermoplastic material on the core yarn to a second coating temperature below a softening temperature of the first thermoplastic material to solidify the first thermoplastic material into the unfoamed coating on the core yarn.

A one hundred and fifty-ninth aspect relates to the method of the one hundred and fifty-eighth aspect, wherein applying the coating further comprises pulling the core yarn through the molten first thermoplastic material.

A one hundred and sixtieth aspect relates to a method for foaming a yarn, the method comprising the steps of: expanding an unfoamed coating of a yarn into a multicellular foam by increasing a temperature of a yarn to a first processing temperature, thereby softening or melting the unfoamed coating, activating a thermally-activated chemical blowing agent in the unfoamed coating, and expanding the unfoamed coating into a multicellular foam; and after expanding the coating into the multicellular foam, decreasing a temperature of the multicellular foam to a second processing temperature at which the multicellular foam adheres to the core yarn and solidifies while retaining its multicellular structure; wherein the yarn comprises a core yarn and a first thermoplastic material forming the unfoamed coating, the first thermoplastic material at least partially surrounds the core yarn, the core yarn comprises a plurality of fibers or filaments, and each of the plurality of fibers or filaments comprising a core material; wherein the first thermoplastic material comprises at least one first thermoplastic polymer chosen from a thermoplastic polyurethane, a thermoplastic polyolefin, a thermoplastic polyester, a thermoplastic polyether, a thermoplastic polyamide, or any combination thereof, the first thermoplastic material further comprises a thermally-activated chemical blowing agent, and the thermally-activated chemical blowing agent is present in the first thermoplastic material in an amount effective to foam the unfoamed coating of the first thermoplastic material into a multicellular foam; and wherein the first processing temperature is a temperature at or above a softening temperature of the first thermoplastic material and at or above an activation temperature of the thermally-activated blowing agent of the first thermoplastic material.

A one hundred and sixty-first aspect relates to the method of the one hundred and sixtieth aspect, wherein the multicellular foam is a cross-linked foam, the first thermoplastic material further comprises a thermally-activated cross-linking agent, and the first processing temperature is a temperature at or above the activation temperature of the thermally-activated cross-linking agent.

A one hundred and sixty-second aspect relates to the method of the one hundred and sixtieth or the one hundred and sixty-first aspect, wherein the core material is a second thermoplastic material, and the first processing temperature is a temperature at least 20 degrees Celsius below a softening temperature of the second thermoplastic material.

The invention claimed is:

1. A textile, comprising:

a first textile layer;

a second textile layer; and a yarn that is inlaid between the first textile layer and the second textile layer, the yarn comprising:

a core yarn;

a multicellular foam comprising a thermoplastic material;

wherein at least a portion of the multicellular foam is in direct contact with the core yarn and is exposed on a surface of the yarn;

wherein the multicellular foam occupies a space between the first textile layer and the second textile layer and further extends through the first textile layer, forming a plurality of raised foam structures on an outer surface of the first textile layer; and wherein the plurality of raised foam structures are distinct in size and/or shape and/or spacing.

2. The textile of claim 1, wherein the multicellular foam comprises a cross-linked foam.

3. The textile of claim 1, wherein the thermoplastic material comprises a thermoplastic polyurethane, a thermoplastic polypropylene, a thermoplastic polyethylene homopolymer or copolymer, a thermoplastic polyester, a thermoplastic polyether, a thermoplastic polyamide, or any combination thereof.

4. The textile of claim 1, wherein the thermoplastic material comprises ethylene-vinyl acetate.

5. The textile of claim 1, wherein the thermoplastic material comprises a cross-linking agent.

6. The textile of claim 5, wherein the cross-linking agent is a thermally-activated cross-linking agent.

7. The textile of claim 1, wherein the core yarn comprises a plurality of fibers or filaments and is a twisted multi-filament yarn or an entangled multi-filament yarn.

8. The textile of claim 1, wherein the multicellular foam comprises an open-celled multicellular foam.

9. The textile of claim 1, wherein the textile is incorporated into an article of footwear or into an article of apparel.

10. An upper, comprising:

a textile, comprising:

a first textile layer;

a second textile layer; and a yarn that is inlaid between the first textile layer and the second textile layer, the yarn comprising:

a core yarn;

a multicellular foam comprising a thermoplastic material;

wherein at least a portion of the multicellular foam is in direct contact with the core yarn and is exposed on a surface of the yarn; and wherein the multicellular foam occupies a space between the first textile layer and the second textile layer and further extends through the first textile layer, forming a plurality of raised foam structures on an outer surface of the first textile layer;

wherein the plurality of raised foam structures are distinct in size and/or shape and/or spacing.

11. The upper of claim 10, wherein the thermoplastic material comprises a thermoplastic polyurethane, a thermoplastic polypropylene, a thermoplastic polyethylene homopolymer or copolymer, a thermoplastic polyester, a thermoplastic polyether, a thermoplastic polyamide, or any combination thereof.

12. The upper of claim 10, wherein the thermoplastic material comprises a cross-linking agent.

13. The upper of claim 10, wherein the core yarn comprises a plurality of fibers or filaments and is a twisted multi-filament yarn or an entangled multi-filament yarn.

14. An article of footwear, comprising:

a textile, comprising:

a first textile layer;

a second textile layer; and a yarn that is inlaid between the first textile layer and the second textile layer, the yarn comprising:

a core yarn;

a multicellular foam comprising a thermoplastic material;

wherein at least a portion of the multicellular foam is in direct contact with the core yarn and is exposed on a surface of the yarn; and wherein the multicellular foam occupies a space between the first textile layer and the second textile layer and further extends through the first textile layer, forming at least one raised foam structure on a surface of the first textile layer.

15. The article of footwear of claim 14, wherein the textile is a knitted textile.

16. The article of footwear of claim 14, wherein the multicellular foam comprises an open-celled multicellular foam.

17. The article of footwear of claim 14, wherein the thermoplastic material comprises a cross-linking agent that is thermally-activated.

18. The article of footwear of claim 14, wherein the thermoplastic material comprises a thermoplastic polyurethane, a thermoplastic polypropylene, a thermoplastic polyethylene homopolymer or copolymer, a thermoplastic polyester, a thermoplastic polyether, a thermoplastic polyamide, or any combination thereof.

19. The article of footwear of claim 14, wherein the core yarn comprises a second thermoplastic material, and the second thermoplastic material comprises a thermoplastic polyurethane; a thermoplastic polyolefin; a thermoplastic polyester; a thermoplastic polyether, a thermoplastic polyamide; or any combination thereof.

20. The article of footwear of claim 14, wherein the core yarn has a deformation temperature that is at least 20 degrees Celsius greater than a melting temperature of the thermoplastic material.

21. An article of footwear, comprising:

a textile, comprising:

a first textile layer;

a second textile layer; and a yarn that is inlaid between the first textile layer and the second textile layer, the yarn comprising:

a core yarn;

a multicellular foam comprising a thermoplastic material;

wherein at least a portion of the multicellular foam is in direct contact with the core yarn and is exposed on a surface of the yarn; and wherein the multicellular foam occupies a space between the first textile layer and the second textile layer and further extends through the first textile layer, forming at least one raised foam structures on a surface of the first textile layer;

wherein the thermoplastic material comprises one or more thermally-activated cross-linking agents.

* * * * *